US008457896B2

(12) United States Patent
Ekseth

(10) Patent No.: US 8,457,896 B2
(45) Date of Patent: Jun. 4, 2013

(54) METHOD AND APPARATUS FOR DETERMINING LOCATIONS OF MULTIPLE CASINGS WITHIN A WELLBORE CONDUCTOR

(75) Inventor: Roger Ekseth, Sjetnemarka (NO)

(73) Assignee: Gyrodata, Incorporated, Houston, TX (US)

( * ) Notice: Subject to any disclaimer, the term of this patent is extended or adjusted under 35 U.S.C. 154(b) by 857 days.

(21) Appl. No.: 12/564,812

(22) Filed: Sep. 22, 2009

(65) Prior Publication Data

US 2011/0067859 A1 Mar. 24, 2011

(51) Int. Cl.
*G01V 1/40* (2006.01)

(52) U.S. Cl.
USPC ..... 702/6

(58) Field of Classification Search
USPC ..... 702/6–13
See application file for complete search history.

(56) References Cited

U.S. PATENT DOCUMENTS 3,735,129 A * 5/1973 Montgomery et al. ..... 378/163
3,847,215 A 11/1974 Herd
5,655,602 A 8/1997 Collins
7,117,605 B2 10/2006 Ekseth et al.

FOREIGN PATENT DOCUMENTS

WO WO 2004/070159 A2 8/2004
WO WO 2009/014838 A1 1/2009

OTHER PUBLICATIONS

Hicks, S., et al., "Magnus: Utilisation of Conductor Sharing Wellhead Technology to Access Additional Hydrocarbons via a Slot-Constrained Platform", dated Sep. 8, 2009, in 10 pages.
International Search Report and Written Opinion issued in related application No. PCT/US2009/067213, on May 13, 2011, in 8 pages.
Wells D.E. & Krakiwsky E.J., "The Method of Least Squares," Lecture Notes vol. 18, Department of Geodesy and Geomatics Engineering, University of New Brunswick, May 1971, pp. 113-116.
Mexican Office Action for Mexican Application No. MX/a/2009/013524 dated Oct. 12, 2012.

* cited by examiner

*Primary Examiner* — Stephen Cherry
(74) *Attorney, Agent, or Firm* — Knobbe, Martens, Olson & Bear LLP

(57) ABSTRACT

Certain embodiments described herein provide methods, systems and computer-readable media for determining at least one location of at least one wellbore casing within a wellbore conductor. Sensor measurements generated by at least one sensor within the conductor are provided, the measurements indicative of at least one location of the at least one casing within the conductor as a function of position along the conductor. In certain embodiments, a data memory stores the measurements. The at least one location of the at least one casing is calculated using the measurements and at least one geometric constraint. The at least one constraint originates at least in part from at least one physical parameter of the conductor, or at least one physical parameter of the at least one casing, or both. In certain embodiments, a computer system or computer-executable component calculates the at least one location of the at least one casing.

21 Claims, 17 Drawing Sheets

METHOD AND APPARATUS FOR DETERMINING LOCATIONS OF MULTIPLE CASINGS WITHIN A WELLBORE CONDUCTOR

BACKGROUND

1. Field

Certain embodiments described herein relate generally to systems and methods for using sensor measurements and at least one geometric constraint to determine at least one location of at least one wellbore casing within a wellbore conductor.

2. Description of the Related Art

Within a wellbore conductor, multiple wellbore casings may be inserted (e.g., by running multiple casings within the conductor and cementing the casings in place). Rotary steerable drilling tools can be equipped with survey instrumentation, such as measurement while drilling (MWD) instrumentation, which provides information regarding the orientation of the survey tool, and, hence, the orientation of the well at the tool location. Survey instrumentation can also be lowered into casings via survey strings before drilling takes place. Survey instrumentation can make use of various measured quantities such as one or more of acceleration, magnetic field, and angular rate to determine the orientation of the tool and the associated wellbore or wellbore casing with respect to a reference vector such as the Earth's gravitational field, magnetic field, or rotation vector. The determination of such directional information at generally regular intervals along the path of the well can be combined with measurements of well depth to allow the trajectory of the well to be estimated.

SUMMARY

In certain embodiments, a method of determining at least one location of at least one wellbore casing within a wellbore conductor is provided. In certain embodiments, the method comprises providing sensor measurements generated by at least one sensor within the wellbore conductor. The sensor measurements of certain embodiments are indicative of at least one location of the at least one wellbore casing within the wellbore conductor as a function of position along the wellbore conductor. The method of certain embodiments further comprises calculating the at least one location of the at least one wellbore casing using the sensor measurements and at least one geometric constraint. The at least one geometric constraint of certain embodiments originates at least in part from at least one physical parameter of the wellbore conductor, or at least one physical parameter of the at least one wellbore casing, or both.

In certain embodiments, a system is provided for determining at least one location of at least one wellbore casing within a wellbore conductor. In certain embodiments, the system comprises a data memory that stores sensor measurements corresponding to measurements from at least one sensor within the wellbore conductor. The sensor measurements of certain embodiments are indicative of at least one location of the at least one wellbore casing within the wellbore conductor as a function of position along the wellbore conductor. The system of certain embodiments further comprises a computer system in communication with the data memory. The computer system of certain embodiments is operative to calculate the at least one location of the at least one wellbore casing using the sensor measurements and at least one geometric constraint. The at least one geometric constraint of certain embodiments originates at least in part from at least one physical parameter of the wellbore conductor, or at least one physical parameter of the at least one wellbore casing, or both.

In certain embodiments, a system is provided for determining at least one location of at least one wellbore casing within a wellbore conductor. In certain embodiments, the system comprises a first component that provides sensor measurements corresponding to measurements from at least one sensor within the wellbore conductor. The sensor measurements of certain embodiments are indicative of at least one location of the at least one wellbore casing within the wellbore conductor as a function of position along the wellbore conductor. The system of certain embodiments further comprises a second component that calculates the at least one location of the at least one wellbore casing using the sensor measurements and at least one geometric constraint. The at least one geometric constraint of certain embodiments originates at least in part from at least one physical parameter of the wellbore conductor, or at least one physical parameter of the at least one wellbore casing, or both. The system of certain embodiments further comprises a computer system operative to execute the first and second components.

In certain embodiments, a computer-readable medium is provided for determining at least one location of at least one wellbore casing within a wellbore conductor. The computer-readable medium has computer-executable components that are executed on a computer system having at least one computing device. In certain embodiments, the computer-executable components comprise a first component that provides sensor measurements corresponding to measurements from at least one sensor within the wellbore conductor. The sensor measurements of certain embodiments are indicative of at least one location of the at least one wellbore casing within the wellbore conductor as a function of position along the wellbore conductor. The computer-executable components of certain embodiments further comprise a second component that calculates the at least one location of the at least one wellbore casing using the sensor measurements and at least one geometric constraint. The at least one geometric constraint of certain embodiments originates at least in part from at least one physical parameter of the wellbore conductor, or at least one physical parameter of the at least one wellbore casing, or both.

DETAILED DESCRIPTION

Certain embodiments described herein provide methods of determining a location of a wellbore casing within a wellbore conductor. Such methods have several applications. For example, in some situations, two or more casings are run through a single conductor. Multiple casings could be used, for example, to make more efficient use of available slots in a template on an off-shore platform. In such a situation, the outer conductor might be nominally vertical, and the two or more casings within it might define initial, near vertical trajectories of two or more wells. In some such situations, beneath the conductor, each well might be required to build inclination with increasing depth so as to move in the direction of a designated target area.

Figure 1:
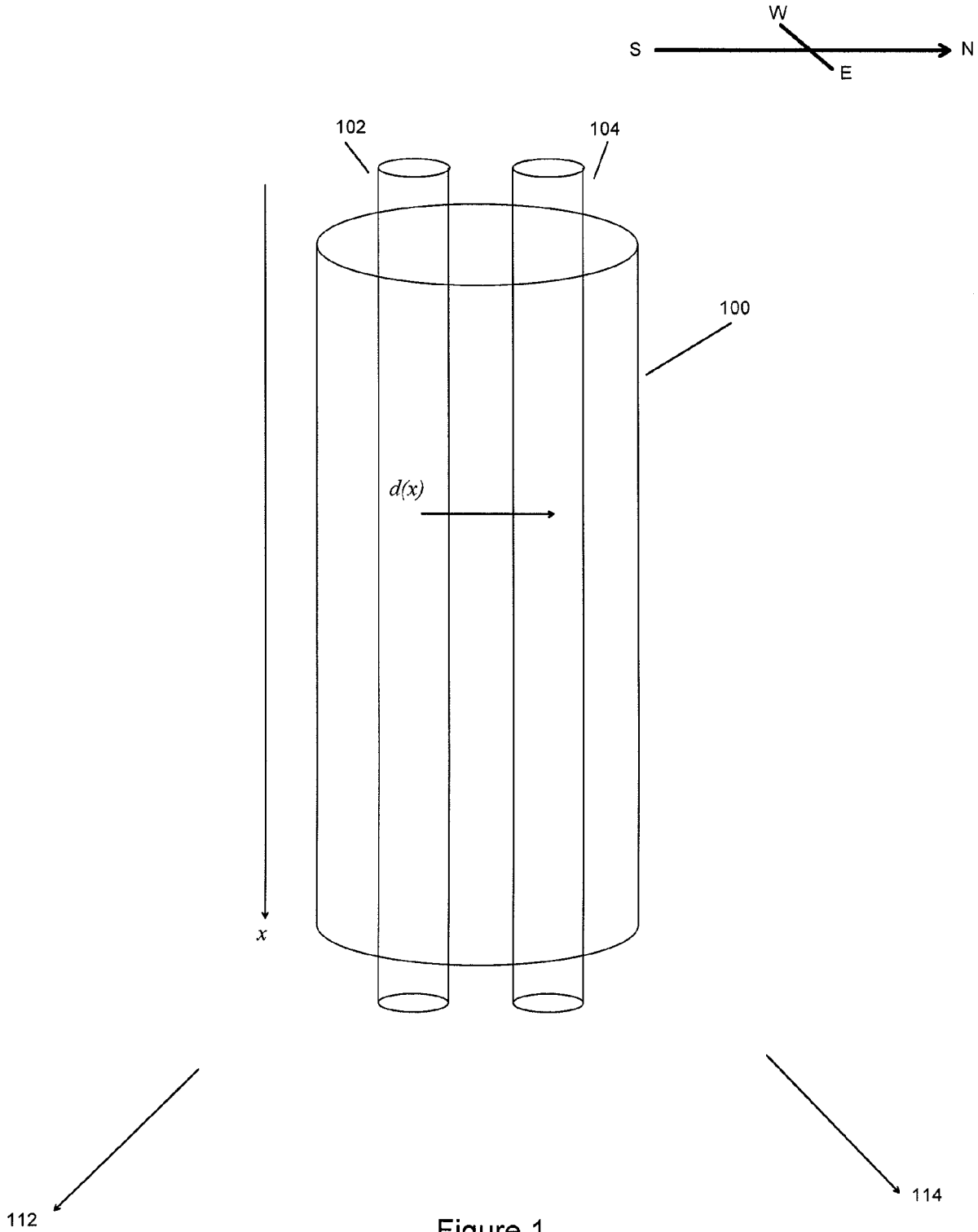
FIG. 1 schematically illustrates wellbore casings within a wellbore conductor and a casing-center-to-casing-center distance vector that remains generally constant.

FIG. 1 schematically illustrates a first wellbore casing 102 and a second wellbore casing 104 within a wellbore conductor 100. In FIG. 1, the first casing 102 has a southerly target destination lying due south (as indicated by a first arrow 112) of the drilling platform and the second casing 104 has a northerly target destination lying due north (as indicated by a second arrow 114) of the drilling platform. In the situation illustrated in FIG. 1, it is intended that the two casings 102, 104 ultimately build angle in order to move towards and intercept their respective targets lying due south and due north of the drilling platform.

In FIG. 1, the centers of the two casings 102, 104 at a position x along the conductor 100 define a distance vector d(x) from the center of the first casing 102 to the center of the second casing 104. In FIG. 1, at the top of the conductor 100, where x=0 (by convention, not out of necessity), the vector d(0) is pointing due north. If the magnitude and direction of d(x) remain relatively constant as x varies up until the point at which the casings 102, 104 begin to build angle to move towards their respective target destinations, then the two casings 102, 104 can reach their respective target destinations with reasonable success.

However, the magnitude and direction of d(x) are likely to depend on the value of x. Although the magnitude and direction of d(x) might be known at the top of the well (when x=0), their values lower down the conductor 100 are more uncertain. This uncertainty can arise, for example, because the casings 102, 104 can move within the outer conductor 100. In some situations, guides used to control the eventual paths of the casings 102, 104 are inserted into the conductor 100 after the conductor 100 is in place. For example, guides having apertures or gaps designed to allow the casings 102, 104 to fit therethrough can be lowered into the conductor 100 on two pipes that extend down the conductor 100 (e.g., to the bottom of the conductor 100). The guides are installed or attached at intervals along these pipes and the casings 102, 104 are then inserted into the conductor 100 through the gaps in the guides. However, as with the unguided configuration in which guides are not used, the magnitude and direction of d(x) may also be uncertain when guides are used. For example, movement of the pipes and/or the guides (e.g., twisting within the conductor 100) during installation of the guides may result in the gaps being located away from their intended positions. In addition, the casings 102, 104 might also move more freely once they pass the lowestmost guide, thereby introducing uncertainty in the values of the magnitude and direction of d(x). Guides are sometimes avoided because the movement (e.g., twisting) of the whole guide structure during insertion into the conductor 100 can make the subsequent operation of inserting the casings 102, 104 difficult. Additionally, a guide structure is typically only inserted into conductors that are vertical or very close to vertical. When guides are not used, the uncertainty in the values of the magnitude and direction of d(x) is often greater than when guides are used.

Figure 2:
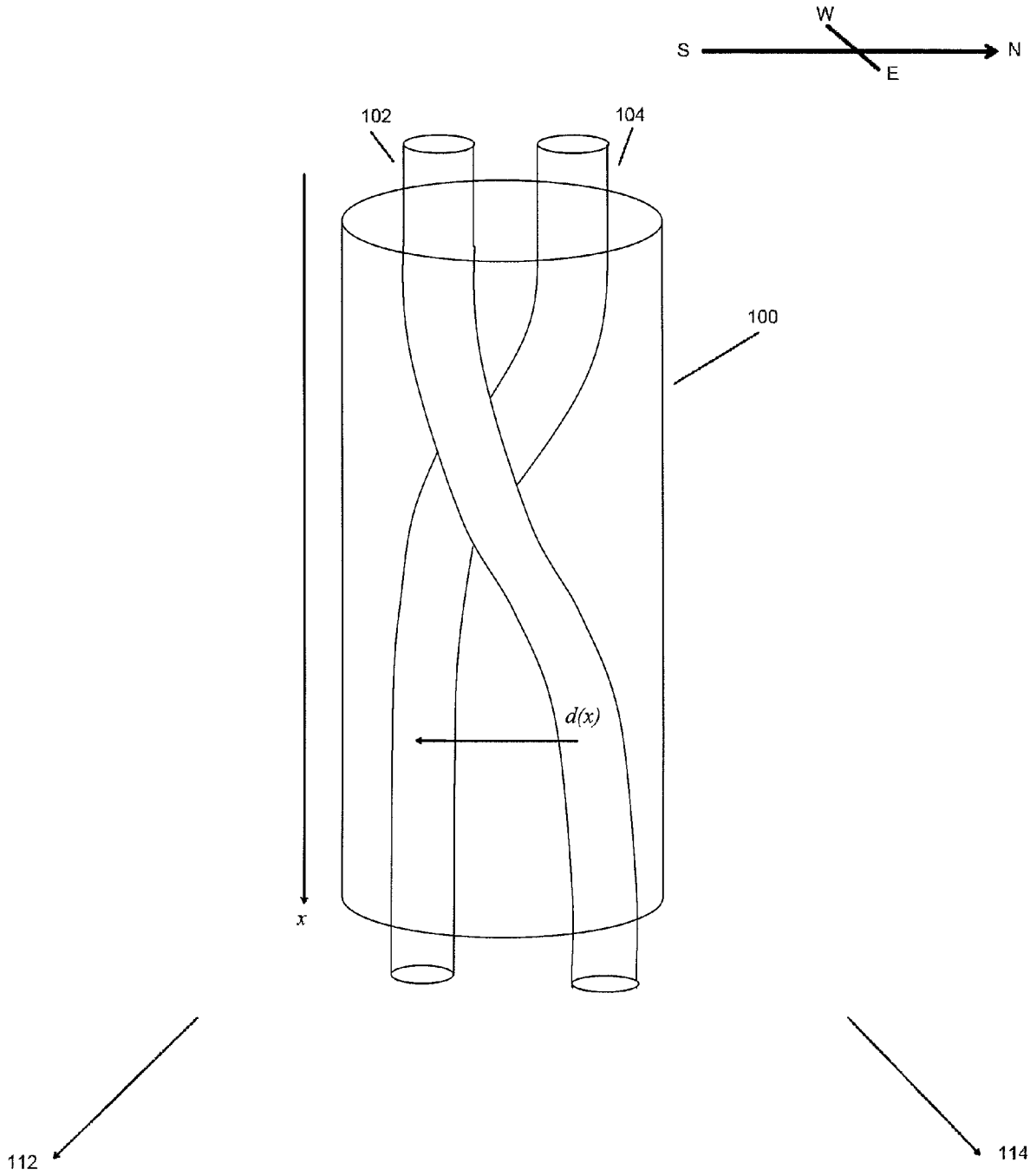
FIG. 2 schematically illustrates wellbore casings within a wellbore conductor and a casing-center-to-casing-center distance vector that does not remain constant.

As schematically illustrated in FIG. 2, in an unguided configuration, the casings 102, 104 can twist during their descent. Such twisting can also occur in a guided configuration in which the guide structure has twisted during insertion. In some circumstances, the casings 102, 104 can end up diametrically opposite to one another relative to their start positions. If, in the situation illustrated in FIG. 2, the two casings 102, 104 build angle toward their respective target destinations below the point at which the casings cross, it is likely that the two well paths would collide. In the situation illustrated in FIG. 2, if it were known that the two well trajectories had changed in the manner described, the first casing 102 could be directed towards the northerly target, and the second casing 104 towards the southerly target, thus decreasing the risk of collision during subsequent drilling phases.

The foregoing example thus illustrates at least one reason it would be useful to accurately determine the location of a wellbore casing within a wellbore conductor. In particular, in the foregoing example it would be useful to accurately determine the positions of the two or more wellbore casings as they emerge from the lower end of the conductor, before further development of each well takes place. While conventional surveying techniques can provide an estimate of the positions of the two or more casings at the lower end of the conductor in this example, there is a substantial possibility that the bottom-hole positions would not be determined with sufficient accuracy. Certain embodiments described herein provide methods of determining a location of a wellbore casing within a wellbore conductor with greater or more acceptable accuracy by making use of one or more geometrical constraints.

Figure 3:
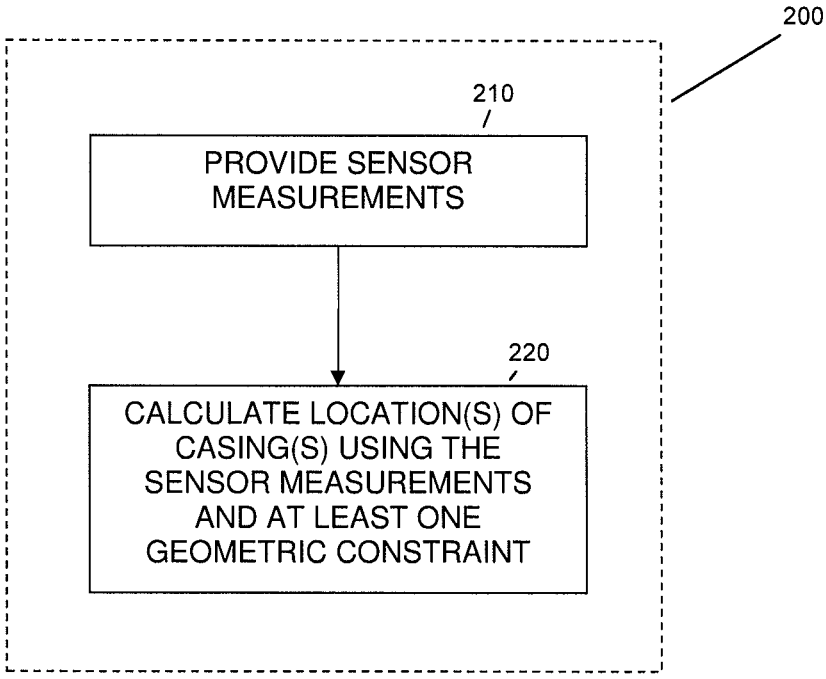
FIG. 3 is a flow diagram of an example method for determining at least one location of at least one wellbore casing within a wellbore conductor in accordance with certain embodiments described herein.

FIG. 3 is a flow diagram of an example method 200 for determining at least one location of at least one wellbore casing within a wellbore conductor in accordance with certain embodiments described herein. In an operational block 210, the method 200 comprises providing sensor measurements generated by at least one sensor within the wellbore conductor, where the sensor measurements are indicative of at least one location of the at least one wellbore casing within the wellbore conductor as a function of position along the wellbore conductor. In a second operational block 220, the method 200 further comprises calculating the at least one location of the at least one wellbore casing using the sensor measurements and at least one geometric constraint. In the method 200, the at least one geometric constraint originates at least in part from at least one physical parameter of the wellbore conductor, or at least one physical parameter of the at least one wellbore casing, or both. Thus, in certain embodiments, the geometry of the conductor and/or the casings plays a role in determining the location or locations of the at least one casing. For example, in certain such embodiments, at least one geometric constraint is used to adjust the sensor measurements to better reflect the geometry of the conductor or to generate estimates of the location of the casing that are more accurate than estimates derived from the sensor measurements alone.

Sensor measurements indicative of the at least one location of the at least one wellbore casing can be provided in many ways. For example, in certain embodiments, providing sensor measurements comprises loading or retrieving data from memory or any other computer storage device. In certain such embodiments and in certain other embodiments, providing sensor measurements comprises receiving signals or data directly from at least one sensor within the conductor.

Figure 4:
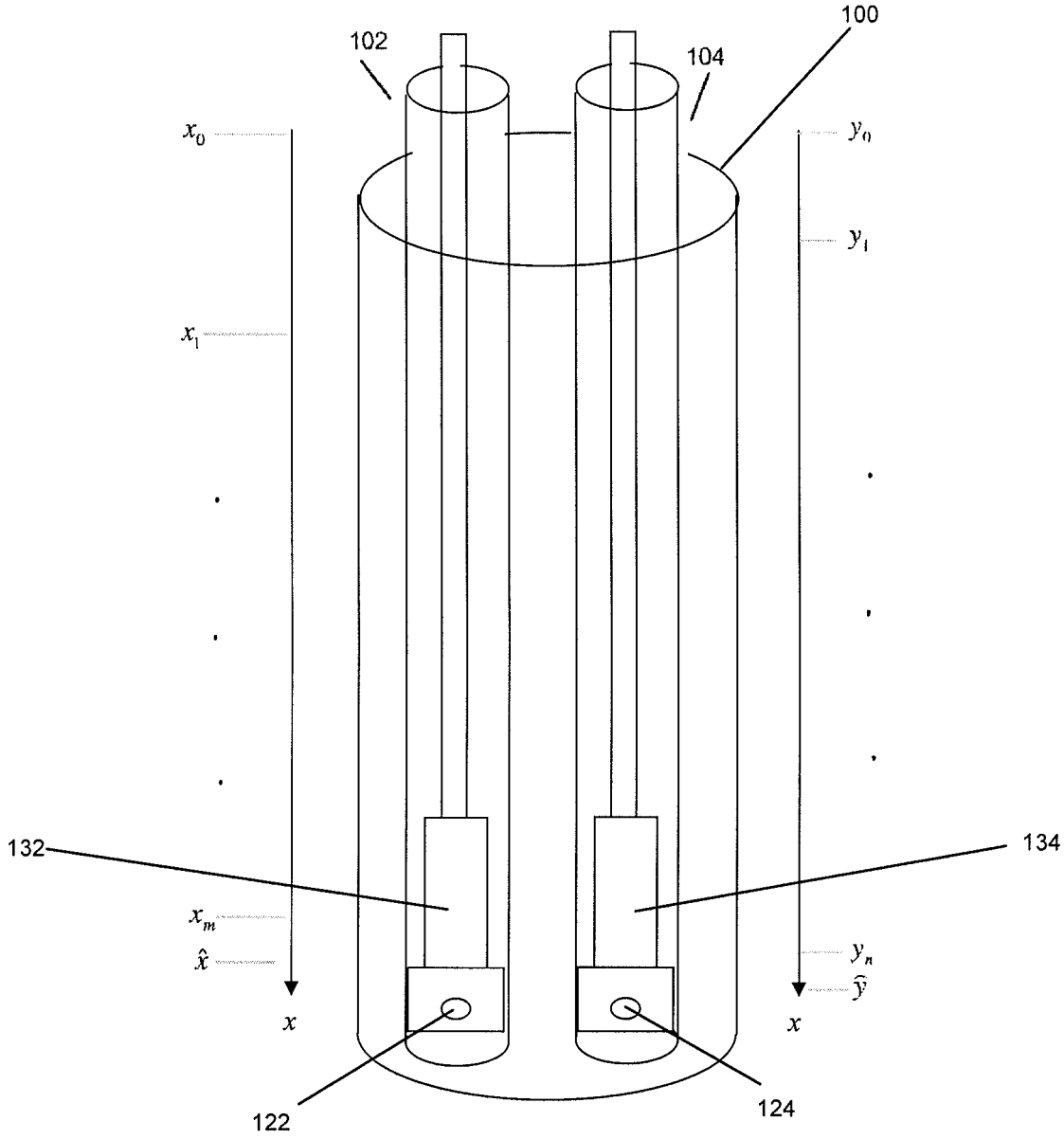
FIG. 4 schematically illustrates an example of wellbore casings within a wellbore conductor, wherein sensors on survey strings in the wellbore casings generate sensor measurements indicative of at least one location of each of the casings in accordance with certain embodiments described herein.

FIG. 4 schematically illustrates an example of at least two wellbore casings 102, 104 within a wellbore conductor 100, in accordance with certain embodiments described herein. In FIG. 4, a first sensor 122 is mounted on a survey string 132 in the first casing 102 and a second sensor 124 is mounted on a survey string 134 in the second casing 104. There are several kinds of sensors 122, 124 that may be used to generate the sensor measurements. For example, in certain embodiments, the sensors 122, 124 comprise one or more of the following: gyroscopes, magnetometers, accelerometers, or some combination thereof. In certain embodiments, the sensors comprise at least one sensor such as those described in U.S. Pat. No. 7,117,605, which is hereby incorporated by reference in its entirety as if set forth fully herein. In addition, while the sensors 122, 124 are shown in FIG. 4 as being positioned at the distal end of the respective survey strings 132, 134, the sensors 122, 124 can be positioned at other locations of the survey strings 132, 134 (e.g., further away from the distal end of the survey strings 132, 134). In certain embodiments, at least one of the survey strings 132, 134 comprises a cable or wireline. In certain such embodiments, the sensor 122, 124 on the at least one survey string 132, 134 comprising a cable or wireline is lowered, using the cable or wireline, into a casing 102, 104 after the casing 102, 104 has been inserted into the conductor 100.

Moreover, there are many ways sensor measurements from the sensors 122, 124 can be indicative of at least one location of the at least one wellbore casing 102, 104 within the wellbore conductor 100 as a function of position along the wellbore conductor 100. In certain embodiments, the first sensor 122 generates measurements with respect to the first casing 102 at positions $x_0, x_1, \ldots, x_m$ along the conductor 100 and the second sensor 124 generates measurements with respect to the second casing 104 at positions $y_0, y_1, \ldots, y_n$ along the conductor 100. The measurements generated by the first sensor 122 are indicative of at least one location of the first casing 102 at a position $\hat{x}$ along the conductor 100. Similarly, the measurements generated by the second sensor 124 are indicative of at least one location of the second casing 102 at a position $\hat{y}$ along the conductor 100. In certain embodiments, the sensor measurements comprise measurements generated at generally regular intervals along the conductor 100. Thus, in FIG. 4, in some embodiments, (1) the positions $x_0, x_1, \ldots, x_m$ are substantially equally spaced along the conductor 100, or (2) the positions $y_0, y_1, \ldots, y_n$ are substantially equally spaced along the conductor 100, or both. In certain other embodiments, the measurements are generated at irregular intervals along the conductor 100. In FIG. 4, m is not necessarily equal to n, such that there may be a different number of measurements generated for one casing 102 than there are for another casing 104. Moreover, some or all of the positions $y_0, y_1, \ldots, y_n$ may coincide with some or all of the positions $x_0, x_1, \ldots, x_m$, but it is not necessary for any of the positions to coincide with one another. In certain embodiments, $\hat{x}$ is distinct from $x_0, x_1, \ldots, x_m$ and in certain other embodiments $\hat{x}$ substantially coincides with $x_m$. In certain embodiments, there may be additional sensors that generate measurements for additional casings not pictured in FIG. 4.

There are also several possibilities for the location or locations of the casings 102, 104 of which the sensor measurements are indicative. For example, in certain embodiments, the sensor measurements from a sensor 122 are taken at intervals of depth or position along the casing 102 or conductor 100. Moreover, in certain embodiments, the sensor measurements from the sensor 122 are indicative of the location of the center of a cross-section of the casing 102. In certain embodiments, the sensor measurements are indicative of the location of a point on an inner perimeter of a cross-section of the casing 102. In certain embodiments, the sensor measurements are indicative of the location or locations of the casings 102, 104 with respect to a designated reference frame. In certain such embodiments, the reference frame is the local geographic frame denoted by the direction of true north, true east and the local vertical. In certain embodiments, the origin of the reference frame is defined by the starting position of the casing 102.

There are several physical parameters of the wellbore conductor 100 and/or the at least one wellbore casing from which the one or more geometric constraints can originate at least in part. For example, in certain embodiments, the conductor 100 is generally cylindrical. In certain such embodiments, the at least one physical parameter of the conductor 100 can be a cross-sectional dimension of the conductor 100. For example, in certain such embodiments, the one or more geometric constraints originate at least in part from the inner diameter or some other diameter of a cross section of the conductor 100 and/or the inner perimeter or some other perimeter of a cross section of the conductor 100 and/or some other geometrical parameter relating to the cross-sectional shape of the conductor 100. Similarly, in certain embodiments, at least one casing 102 is generally cylindrical. In certain such embodiments, the at least one physical parameter of the at least one cylindrical casing 102 can be a cross-sectional dimension of the at least one casing 102. For example, in certain such embodiments, the one or more geometric constraints originate at least in part from the outer diameter or some other diameter of a cross section of the casing 102 and/or the outer perimeter or some other perimeter of a cross section of the casing 102 and/or some other geometrical parameter relating to the cross-sectional shape of the casing 102.

Figure 5:
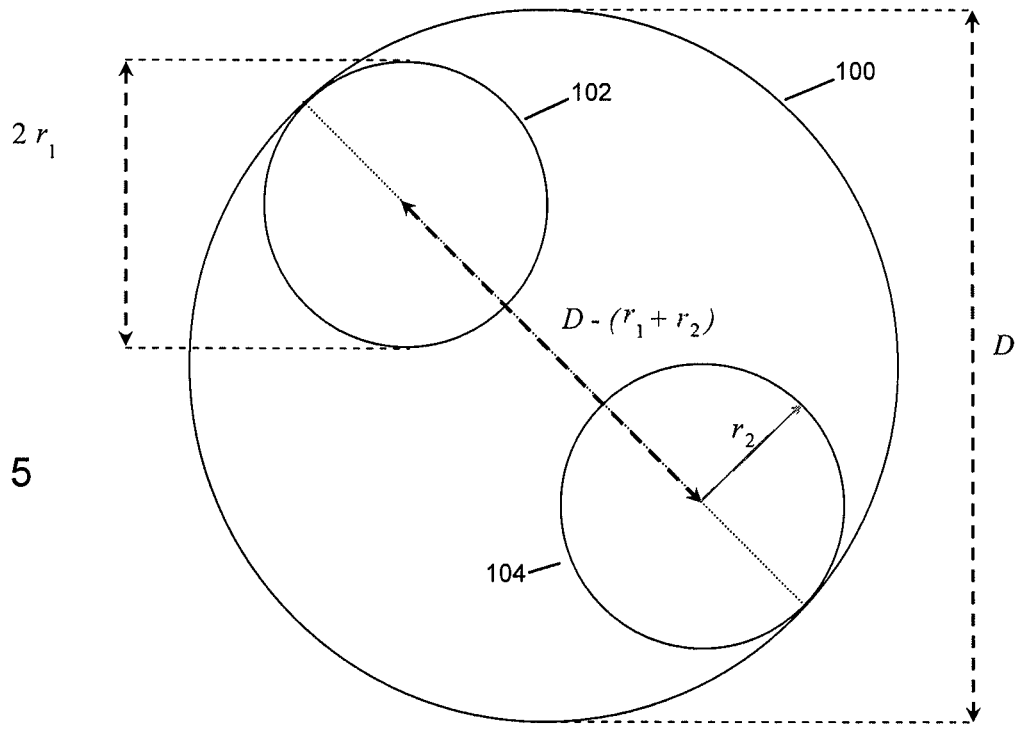
FIG. 5 schematically illustrates two wellbore casings within a wellbore conductor separated by a maximum center-to-center distance.
Figure 6:
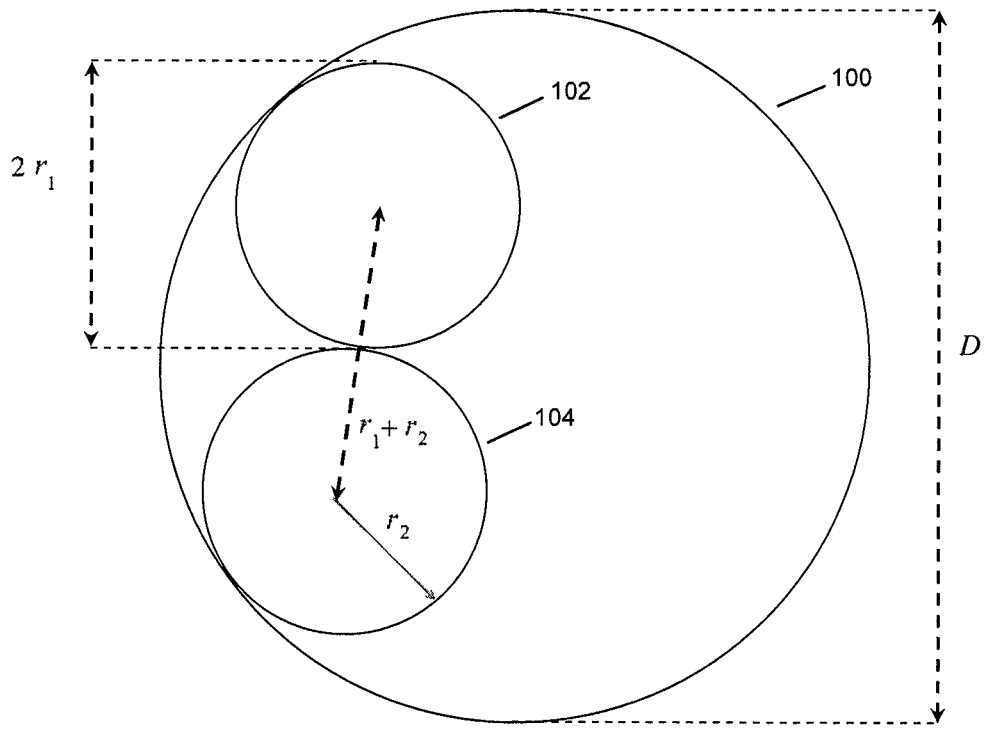
FIG. 6 schematically illustrates two wellbore casings within a wellbore conductor separated by a minimum center-to-center distance.

In certain embodiments, the geometric constraint is a minimum or maximum distance between casings. For example, FIG. 5 schematically illustrates a cross section view of two casings 102, 104 within a conductor 100 in accordance with certain embodiments. As FIG. 5 illustrates, a possible geometric constraint for such embodiments is a maximum distance between the centers of the two casings 102, 104 defined by $D-(r_1+r_2)$, where D is the inner diameter of the conductor 100 and $r_1$ and $r_2$ are the respective outer radii of the two casings 102, 104. Similarly, as FIG. 6 illustrates, a possible geometric constraint for certain embodiments is a minimum distance between the centers of the two casings 102, 104 defined by $r_1+r_2$. In certain embodiments, the radii $r_1$ and $r_2$ are substantially equal to one another, while in certain other embodiments, the two radii $r_1$ and $r_2$ are substantially different from one another.

Figure 7:
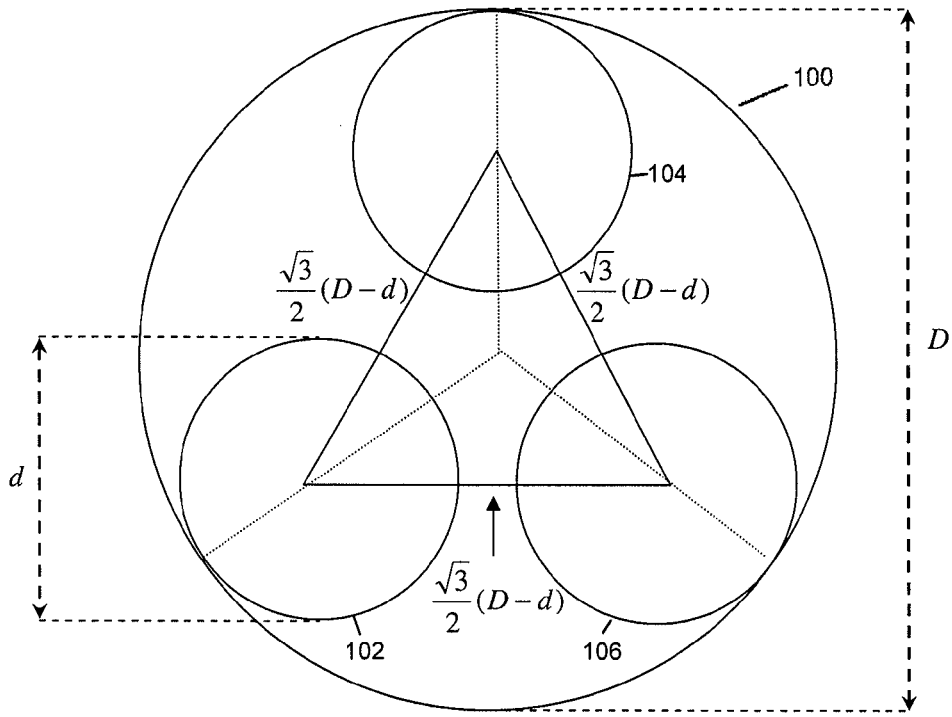
FIG. 7 schematically illustrates three wellbore casings within a wellbore conductor separated by a maximum center-to-center distance.
Figure 8:
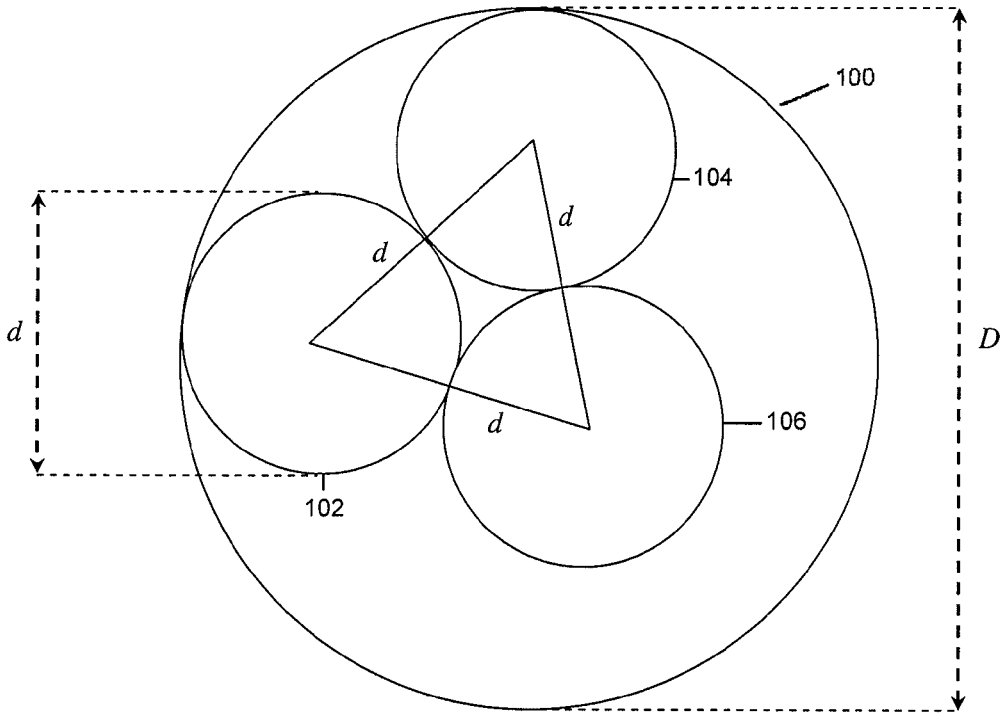
FIG. 8 schematically illustrates three wellbore casings within a wellbore conductor separated by a minimum center-to-center distance.
Figure 9:
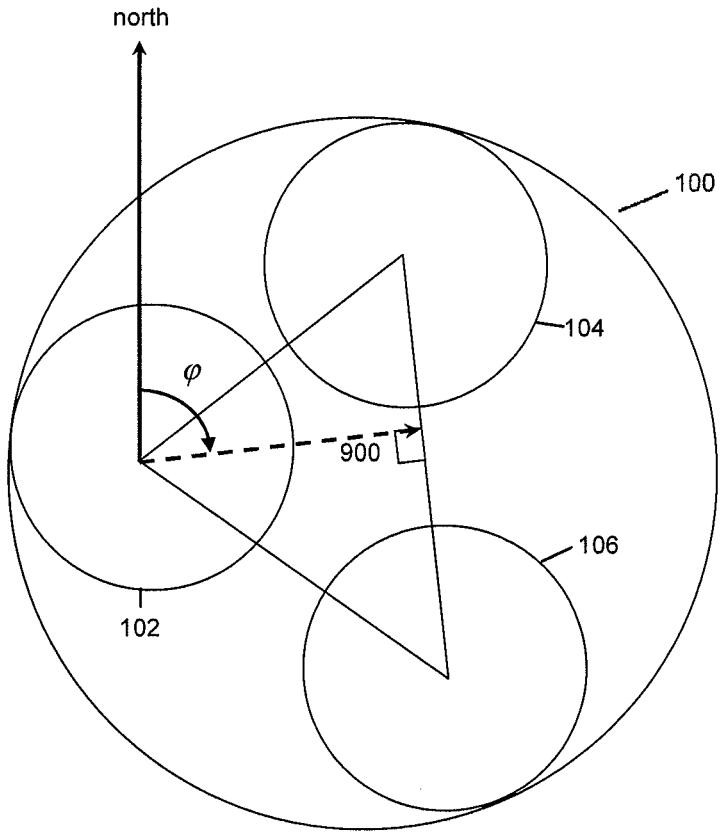
FIG. 9 schematically illustrates three wellbore casings within a wellbore conductor and a vector representing a relative orientation of the three wellbore casings in accordance with certain embodiments described herein.

FIG. 7 schematically illustrates a cross section view of three casings 102, 104, 106 of equal diameter within a conductor 100 in accordance with certain embodiments. As FIG. 7 illustrates, a possible geometric constraint for such embodiments is a maximum total distance between the centers of the three casings 102, 104, 106 defined by $$\frac{3\sqrt{3}}{2}(D-d),$$

where D is the inner diameter of the conductor 100 and d is the outer diameter of each of the three casings 102, 104, 106. Similarly, as FIG. 8 illustrates, a possible geometric constraint for such embodiments is a minimum total distance between the centers of the three casings 102, 104, 106 defined by 3d. In certain embodiments, one or more of the casings 102, 104, 106 can have a different radius than one or more other casings of the casings 102, 104, 106. Moreover, as FIG. 9 illustrates, a possible geometric constraint for such embodiments is a vector 900 representing a relative orientation of the three casings 102, 104, 106. For example, the vector 900 can be constrained to point in a predetermined direction based on the geometry of the casings 102, 104, 106 and the conductor 100.

Figure 10:
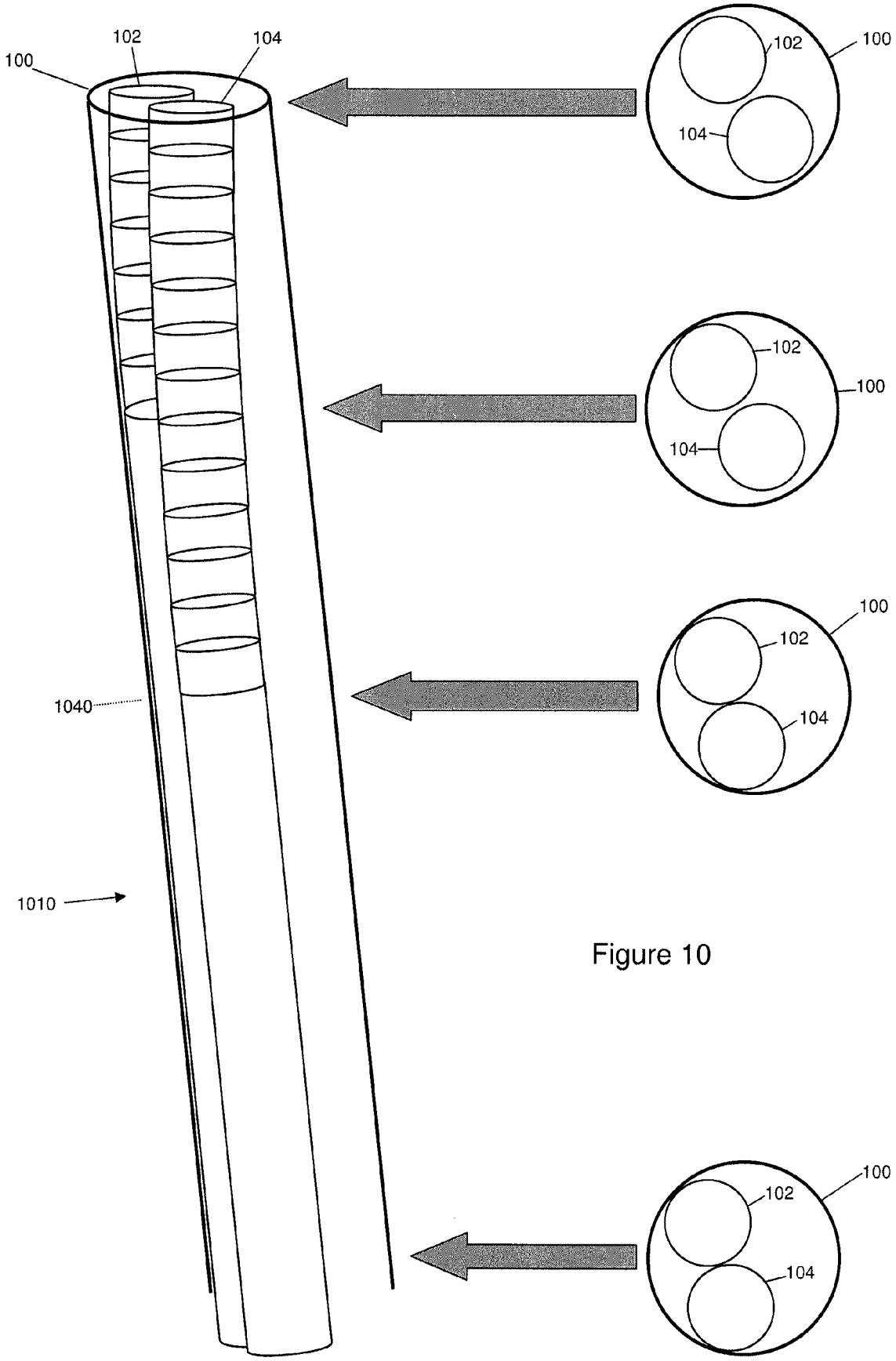
FIG. 10 schematically illustrates wellbore casings within a wellbore conductor, wherein the wellbore casings eventually touch one another.

In certain embodiments, the conductor 100 is not aligned completely vertically, making it likely that the two or more casings will eventually touch the conductor 100 and/or one another. For example, an alignment 0.1 to 0.2 degrees off of the vertical in a large-diameter conductor 100 that is 300 meters or longer is sufficient to make it likely that two casings 102, 104 within the conductor 100 will touch the "lower side" of the conductor 100 before emerging from the bottom of the conductor 100. As FIG. 10 schematically illustrates, in some embodiments, at least one of the casings 102 eventually reaches the "lower side" 1010 of the conductor 100 and thereafter rests up against the conductor 100. In some such embodiments, as illustrated in FIG. 10, a second casing 104 will touch this first casing 102 and thereafter rest up against the first casing 102 and/or the lower side 1010 of the conductor 100. The position 1040 along the conductor 100 at which the casings 102, 104 touch one another can be referred to as the "meeting point."

Figure 11:
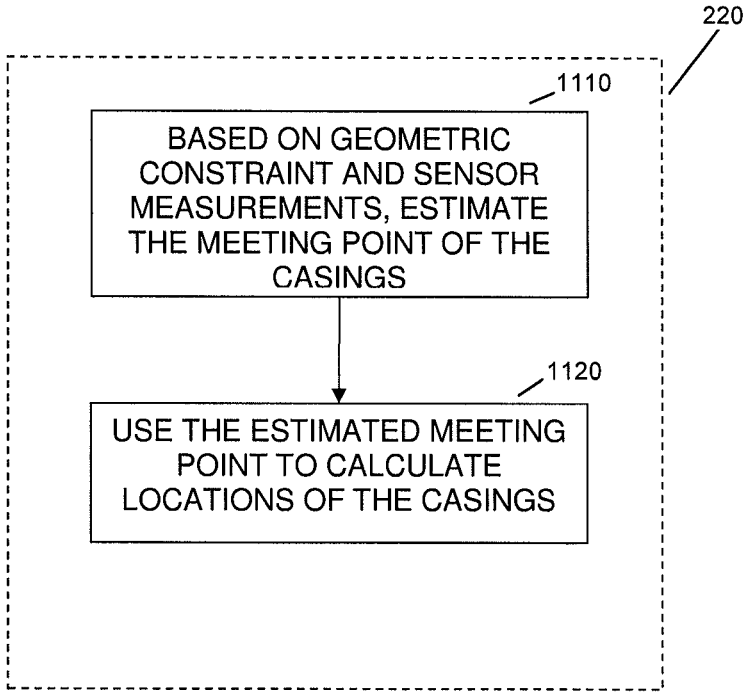
FIG. 11 is a flow diagram of an example method for calculating at least one location of at least one wellbore casing within a wellbore conductor in accordance with certain embodiments described herein.

FIG. 11 is a flow diagram of an example of the operational block or method 220 of FIG. 3 for calculating at least one location of at least one wellbore casing using sensor measurements and at least one geometric constraint in accordance with certain embodiments described herein. In an operational block 1110, the method 220 comprises estimating, based at least in part on the at least one geometric constraint and the sensor measurements, a position along the wellbore conductor 100 at which first and second wellbore casings 102, 104 touch one another. For example, in some embodiments, a minimum distance between the first and second wellbore casings 102, 104 is used as at least one geometric constraint in the analysis of sensor measurements to determine at what depth the casings 102, 104 touch one another; in certain such embodiments the minimum distance is utilized because, when the casings 102, 104 touch, the distance between them will be minimized.

In a second operational block 1120 of FIG. 11, the method 220 further comprises using the estimated position along the conductor 100 at which the first and second casings 102, 104 touch one another to calculate locations of the first and second casings 102, 104. For example, in certain embodiments, using the estimated position to calculate locations of the first and second casings 102, 104 comprises assuming that the first and second casings 102, 104 continue to touch one another at depths below the estimated position along the conductor 100 and using this assumption in conjunction with the sensor measurements to generate estimates of locations of the first and second casings 102, 104.

In certain embodiments, one or more sensors are components of a wireline survey system and are lowered and raised within at least some of the one or more casings to survey the location or locations of the casings. In certain other embodiments, one or more sensors are components of one or more of the casing or casings (e.g., are mounted at fixed positions within a casing) and are installed with those one or more casings within the conductor. In certain other embodiments, one or more sensors are components of the wellbore conductor (e.g., are mounted at fixed positions within the conductor and are configured to provide information regarding the locations of casings within the conductor).

In certain embodiments, a system for determining at least one location of at least one wellbore casing 102 within a wellbore conductor 100 is provided. The system comprises a data memory that stores sensor measurements indicative of at least one location of the at least one wellbore casing 102 within the wellbore conductor 100 as a function of position along the wellbore conductor 100. The data memory can be in any of several forms. For example, in certain embodiments, the data memory comprises read-only memory, dynamic random-access memory, flash memory, hard disk drive, compact disk, and/or digital video disk.

The system further comprises a computer system or controller in communication with the data memory. The computer system is operative to calculate at least one location of the at least one wellbore casing 102 using the sensor measurements and at least one geometric constraint originating at least in part from at least one physical parameter of the wellbore conductor 100, or at least one physical parameter of the at least one wellbore casing 102, or both. In certain embodiments, the computer system comprises a microprocessor operative to perform at least a portion of one or more methods described herein of determining at least one location of at least one wellbore casing 102. The computer system can comprise hardware, software, or a combination of both hardware and software. In certain embodiments, the computer system comprises a standard personal computer or microcontroller. In certain embodiments, the computer system is distributed among multiple computers. In certain embodiments, the computer system comprises appropriate interfaces (e.g., network cards and/or modems) to receive measurement signals from a sensor 122. The computer system can comprise standard communication components (e.g., keyboard, mouse, toggle switches) for receiving user input, and can comprise standard communication components (e.g., image display screen, alphanumeric meters, printers) for displaying and/or recording operation parameters, casing orientation and/or location coordinates, or other information relating to the conductor 100, the at least one casing 102 and/or a survey string 132. In certain embodiments, at least a portion of the computer system is located within a downhole portion of the survey string 132. In certain other embodiments, at least a portion of the computer system is located at the surface and is communicatively coupled to a downhole portion of the survey string 132 within the wellbore casing 102. In certain embodiments, signals from the downhole portion are transmitted by a wire or cable (e.g., electrical or optical) extending along an elongate portion of the survey string 132. In certain such embodiments, the elongate portion may comprise signal conduits through which signals are transmitted from a sensor 122 within the downhole portion to the controller and/or the computer system with which the controller is in communication. In certain embodiments in which the controller is adapted to generate control signals for various components of the downhole portion of the survey string 132, the elongate portion of the survey string 132 is adapted to transmit the control signals from the controller to the downhole portion.

In certain embodiments, a system for determining at least one location of at least one wellbore casing 102 within a wellbore conductor 100 is provided. The system comprises first and second components, wherein the first component provides sensor measurements and the second component calculates at least one location of the at least one wellbore casing 102 using the sensor measurements and at least one geometric constraint. The first and second components each can comprise hardware, software, or a combination of both hardware and software. In certain embodiments, the first component comprises software operative to retrieve sensor measurements stored in a data memory. In certain such embodiments and in certain other embodiments, the first component comprises software and/or hardware operative to relay signals generated by a sensor 122. In certain such embodiments, the first component is operative to relay the signals to the second component and/or a computer system described herein. In certain embodiments, the second component comprises a microprocessor operative to perform at least a portion of one or more methods described herein of determining at least one location of at least one wellbore casing 102. In certain such embodiments and in certain other embodiments, the second component comprises software that, when executed, performs at least a portion of one or more methods described herein of determining at least one location of at least one wellbore casing 102.

The system further comprises a computer system operative to execute the first and second components. In certain embodiments, the computer system comprises a microprocessor operative to execute the first and second components. In certain embodiments, the computer system comprises a bus operative to transfer data between the first and second components. The computer system can comprise hardware or a combination of both hardware and software. In certain embodiments, the computer system comprises a standard personal computer. In certain embodiments, the computer system is distributed among multiple computers. In certain embodiments, the computer system comprises appropriate interfaces (e.g., network cards and/or modems) to receive measurement signals from a sensor 122. The computer system can comprise standard communication components (e.g., keyboard, mouse, toggle switches) for receiving user input, and can comprise standard communication components (e.g., image display screen, alphanumeric meters, printers) for displaying and/or recording operation parameters, casing orientation and/or location coordinates, or other information relating to the conductor 100, the at least one casing 102 and/or a survey string 132.

In certain embodiments, a computer-readable medium for determining at least one location of at least one wellbore casing 102 within a wellbore conductor 100 is provided. The computer-readable medium can be in any of several forms. For example, in certain embodiments, the computer-readable medium comprises read-only memory, dynamic random-access memory, flash memory, hard disk drive, compact disk, and/or digital video disk. The computer-readable medium has computer-executable components, executed on a computer system having at least one computing device. In certain such embodiments, the computer-executable components comprise first and second components as described above with respect to other embodiments, wherein the first component provides sensor measurements and the second component calculates at least one location of the at least one wellbore casing 102 using the sensor measurements and at least one geometric constraint. The computer system on which the computer-executable components are executed can be any of the computer systems described above with respect to other embodiments.

FURTHER EXAMPLES

In certain embodiments, multiple surveys of each casing within the conductor are conducted. In certain embodiments, quality control tests are carried out to check for gross errors in these surveys. In some such embodiments, provided that the surveys are free from gross errors, an average trajectory is generated for each casing using the constituent positional surveys that have been conducted. In certain of these embodiments, determining the location of a given casing comprises determining the position of the center of the casing within the cross section of the conductor at a particular position along the conductor. In certain such embodiments, the distance and direction from the center of one casing to the center of another is determined at various positions along the length of the conductor and a statistical trend analysis of these data is performed. Geometrical constraints are imposed by the surrounding conductor, which bounds the casing trajectories. For example, in certain embodiments the trajectories must all lie within the inner diameter D of the conductor.

Two Unguided Casings Within a Conductor

In certain embodiments, two casings 102, 104 of equal diameter are placed within the conductor 100. As illustrated in FIG. 5 (for the case where $2r_1=2r_2=d$), in such embodiments, the center-to-center separation between the two trajectories at any depth within the conductor 100 cannot be less than the outer diameter d of the casings 102, 104, and cannot exceed the difference between the inner diameter of the conductor 100 and the outer diameter of the casing 102, 104, i.e., cannot exceed D−d. This knowledge can be used to make a judgment regarding the validity of the measured locations of the casings 102, 104 and/or the computed center-to-center separation. Since the locations of and/or distance between the casings 102, 104 affects the direction of the vector from the center of one casing 102 to the center of the other casing 104, this knowledge regarding geometric constraints can also be used to make a judgment regarding the validity of the computed center-to-center direction. As described above, it is useful to keep track of changes in the center-to-center direction in order to ensure that correct decisions regarding the subsequent development of the two wells can be made.

Figure 12:
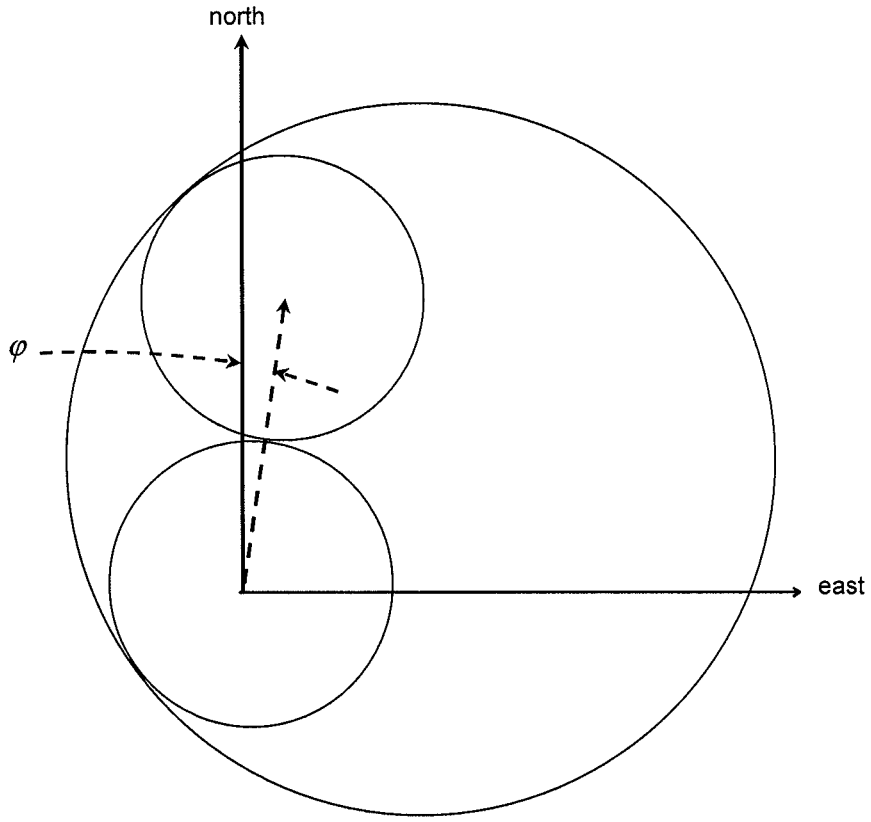
FIG. 12 schematically illustrates two wellbore casings within a wellbore conductor and the orientation of a center-to-center vector relative to a reference direction.

In certain embodiments, the location of the center of a casing 102, 104 at a given depth or position x along the conductor 100 is specified in terms of coordinates. As an example, the following description uses north and east coordinates, although other coordinate systems may be used. The center-to-center separation d(x) at position x is given by $$d(x)=\sqrt{(N_2(x)-N_1(x))^2+(E_2(x)-E_1(x))^2}, \quad \text{(Eq. 1)}$$

and, as schematically illustrated in FIG. 12, the center-to-center direction at position x with respect to reference north is given by $$\varphi(x) = \arctan\left(\frac{E_2(x) - E_1(x)}{N_2(x) - N_1(x)}\right), \quad \text{(Eq. 2)}$$

where $N_1(x)$ and $E_1(x)$ are the measured north and east coordinates of the first casing 102 at position x along the conductor and $N_2(x)$ and $E_2(x)$ are the measured north and east coordinates of the second casing 104 at x. Depending on the conventions used for the coordinate system (e.g., the north-east coordinates), angles, and/or the reference direction, other versions of Equation (2) may be used. Similarly, a suitable range for the arctangent function may be chosen depending on the conventions used for the coordinate system, the angles, the reference direction and/or the locations of the casings 102, 104 within the conductor 100.

Three Unguided Casings Within a Conductor

In certain embodiments, three casings 102, 104, 106 of equal outer diameter d are inserted within the conductor 100. In certain such embodiments, it is appropriate to monitor the sum of the pairwise separations between the centers of the three casings 102, 104, 106 as a function of position along the conductor 100. As illustrated in FIG. 7, the maximum total center-to-center separation, which occurs when the three casings 102, 104, 106 are each touching the inner wall of the conductor 100 and when the centers of the three casings 102, 104, 106 form an equilateral triangle, equates to a distance of $$\frac{3\sqrt{3}}{2}(D-d).$$

The minimum total center-to-center separation for three casings 102, 104, 106 is 3d, which occurs when the casings 102, 104, 106 are in contact with one another, as illustrated in FIG. 8. In certain such embodiments, the relative positions of the casings 102, 104, 106 can be tracked by monitoring the direction (angle $\phi$) of a "casing direction vector," as illustrated in FIG. 9 with respect to a reference direction (e.g., north). As illustrated in FIG. 9, in certain such embodiments, a casing direction vector 900 is determined by the perpendicular from the center point of one casing 102 to the opposite side of the triangle that is formed by the center points of the three casings 102, 104, 106. In certain embodiments, it is sufficient to monitor the casing direction vector 900 since the direction of this vector 900 will be a function of all three casing locations within the conductor 100. In some such embodiments, keeping track of a single casing direction vector 900 is sufficient because of the relative sizes of the casings 102, 104, 106 and conductor 100.

Figure 13:
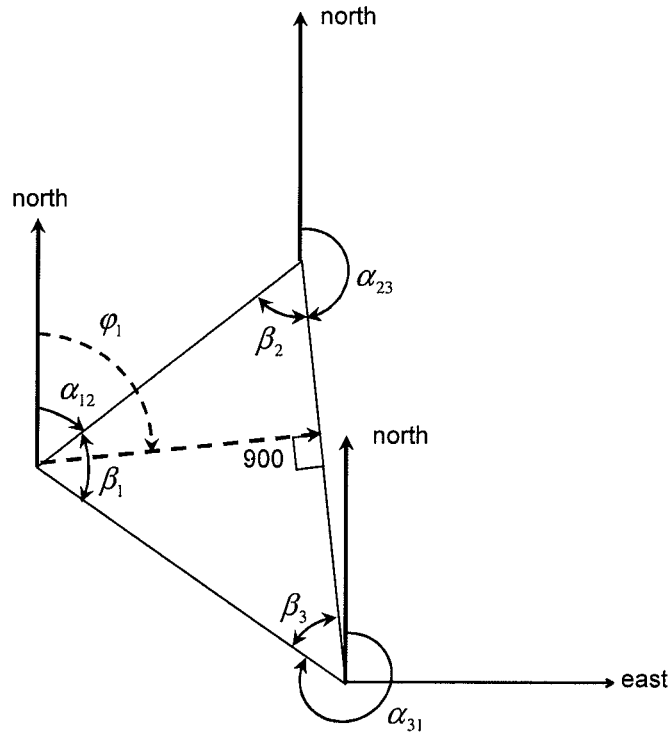
FIG. 13 schematically illustrates a triangle formed by the centers of three wellbore casings within a wellbore conductor and the orientations of center-to-center vectors relative to a reference direction.

In certain embodiments, the location of the center of a casing 102, 104, 106 at a given depth or position x along the conductor is specified in terms of north and east coordinates. The center-to-center separation between the ith and jth casings at position x is $$d_{i,j}(x)=\sqrt{(N_j(x)-N_i(x))^2+(E_j(x)-E_i(x))^2}, \quad \text{(Eq. 3)}$$

and the total center-to-center separation at position x is $$d(x)=d_{1,2}(x)+d_{2,3}(x)+d_{3,1}(x), \quad \text{(Eq. 4)}$$

where $N_i(x)$ and $E_i(x)$ are the measured north and east coordinates of the ith casing at position x along the conductor 100. As schematically illustrated in FIG. 13, the center-to-center casing direction from the ith casing to the jth casing at position x with respect to reference north is $$\alpha_{i,j}(x) = \arctan\left(\frac{E_j(x) - E_i(x)}{N_j(x) - N_i(x)}\right). \quad \text{(Eq. 5)}$$

As described above with respect to Equation (2), the terms of Equation (5) and/or the range of the arctangent function used therein may depend on the conventions used for the coordinate system, the angles, the reference direction, and/or the locations of the casings 102, 104, 106 in the conductor 100. At any given position x along the conductor 100, the centers of the three casings 102, 104, 106 form a triangle. The internal angles $\beta_i(x)$ of this triangle at the vertex corresponding to the center of the ith casing can be calculated using well known geometric relations. The formula for $\beta_i(x)$ may depend, however, on the conventions used for the coordinate system, the angles, the reference direction, and/or the locations of the casings 102, 104, 106 in the conductor 100. For example, if, as illustrated in FIG. 13, angles are defined to be positive going clockwise starting from reference north, and if $\alpha_{3,1}(x)>180°$, then angle $\beta_1(x)$ may be expressed as:

$$\beta_1(x)=\alpha_{3,1}(x)-\alpha_{1,2}(x)-180°. \quad \text{(Eq. 6)}$$

The value of $\alpha_{3,1}(x)$ may depend in part on the locations of the casings 102, 104, 106 within the conductor 100, so whether Equation (6) applies may depend in part on the locations of the casings 102, 104, 106 within the conductor 100. Similarly, Equation (6) may need to be adjusted if, for example, negative values for angles are allowed. In certain embodiments, the relative positions of the casings 102, 104, 106 are tracked by monitoring the direction of the casing direction vector with respect to a given casing and a reference direction (e.g., north). For example, in some situations, the direction $\phi_1(x)$ of the casing direction vector 900 with respect to the first casing 102 and reference north at position x is $$\phi_1(x)=\alpha_{1,2}(x)-\beta_2(x)+90°. \quad \text{(Eq. 7)}$$

However, as with Equations (2), (5) and (6), the form of Equation (7) for the formula for $\phi_1(x)$ may depend on the conventions used for the coordinate system, the angles, the reference direction, and/or the locations of the casings 102, 104, 106 in the conductor 100.

Four Unguided Casings Within a Conductor

Figure 14:
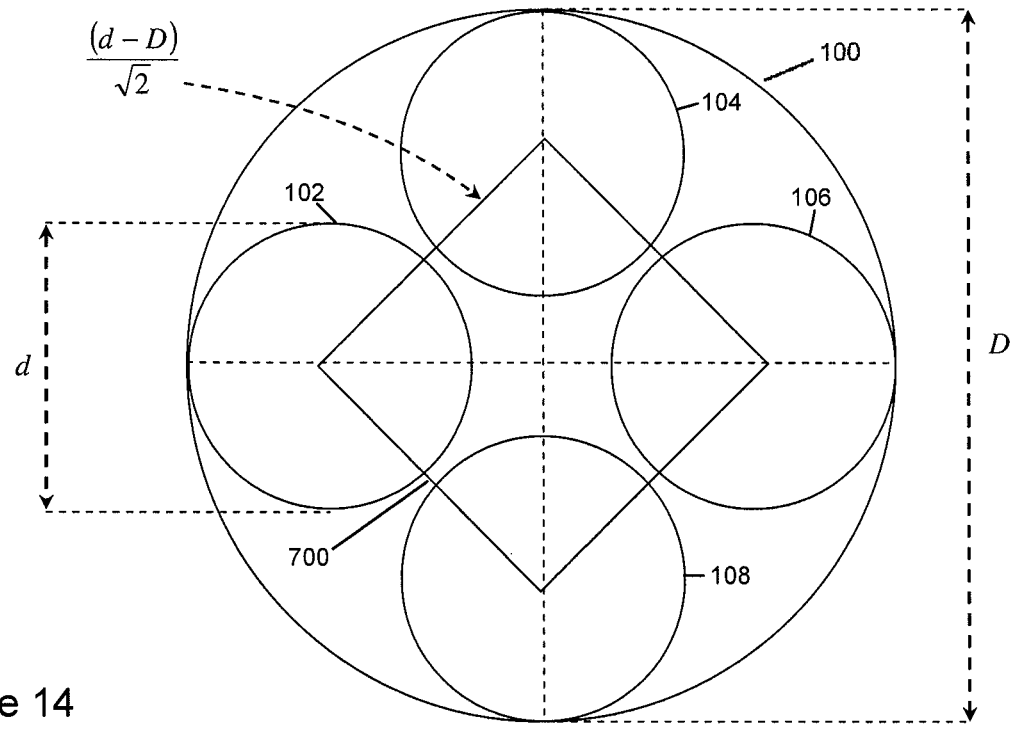
FIG. 14 schematically illustrates four wellbore casings within a wellbore conductor separated by a maximum center-to-center distance.
Figure 15:
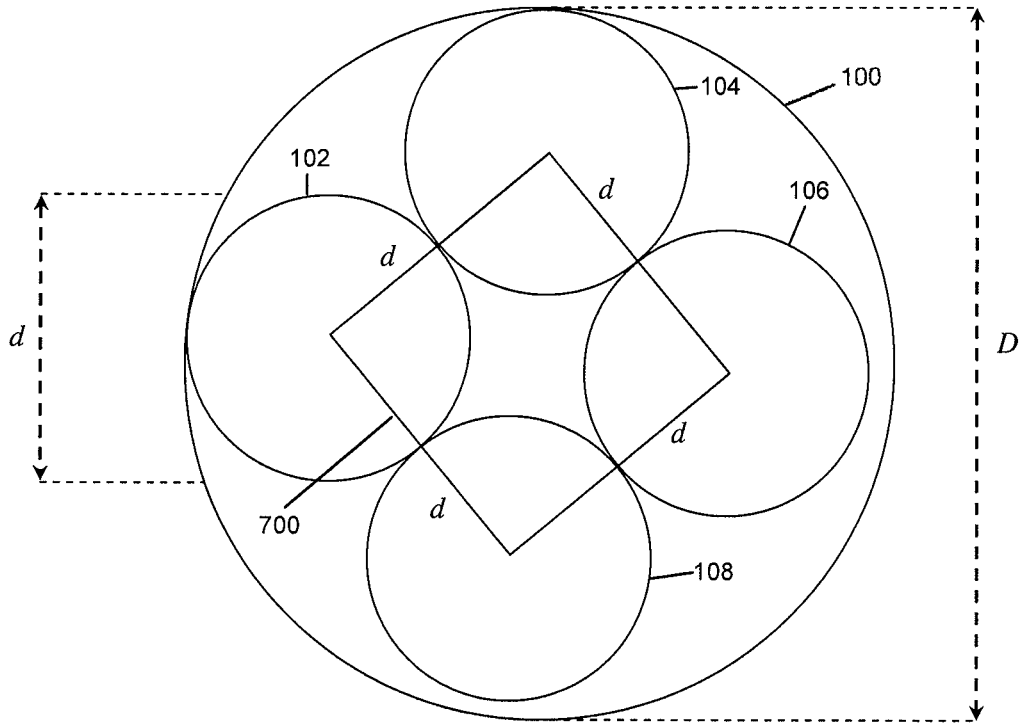
FIG. 15 schematically illustrates four wellbore casings within a wellbore conductor separated by a minimum center-to-center distance.

In certain embodiments, four casings 102, 104, 106, 108 of equal outer diameter d are inserted within the conductor 100. At a given position along the conductor 100, the centers of the four casings 102, 104, 106, 108 form a quadrilateral 700, as schematically illustrated in FIGS. 14 and 15. In certain such embodiments, it is appropriate to monitor the length of the perimeter of the quadrilateral 700 as a function of position along the conductor 100. As illustrated in FIGS. 14 and 15, the length of the perimeter can vary from a minimum value of 4d, when the four casings 102, 104, 106, 108 are in contact with one another, to a maximum value of $2\sqrt{2}(D-d)$, when the casings 102, 104, 106, 108 are equally distributed around the inner perimeter of the conductor 100. In certain embodiments, the relative locations of the casings 102, 104, 106, 108 as a function of position along the conductor 100 can be monitored by keeping track of the direction of the vector joining opposite corners of the quadrilateral 700. In certain such embodiments, monitoring the direction of a single diagonal of the quadrilateral 700 will be sufficient to keep track of, with the requisite accuracy, relative changes in all four casing positions within the conductor 100. In some such embodiments, keeping track of a single diagonal vector is sufficient because of the relative sizes of the casings 102, 104, 106, 108 and conductor 100.

Figure 16:
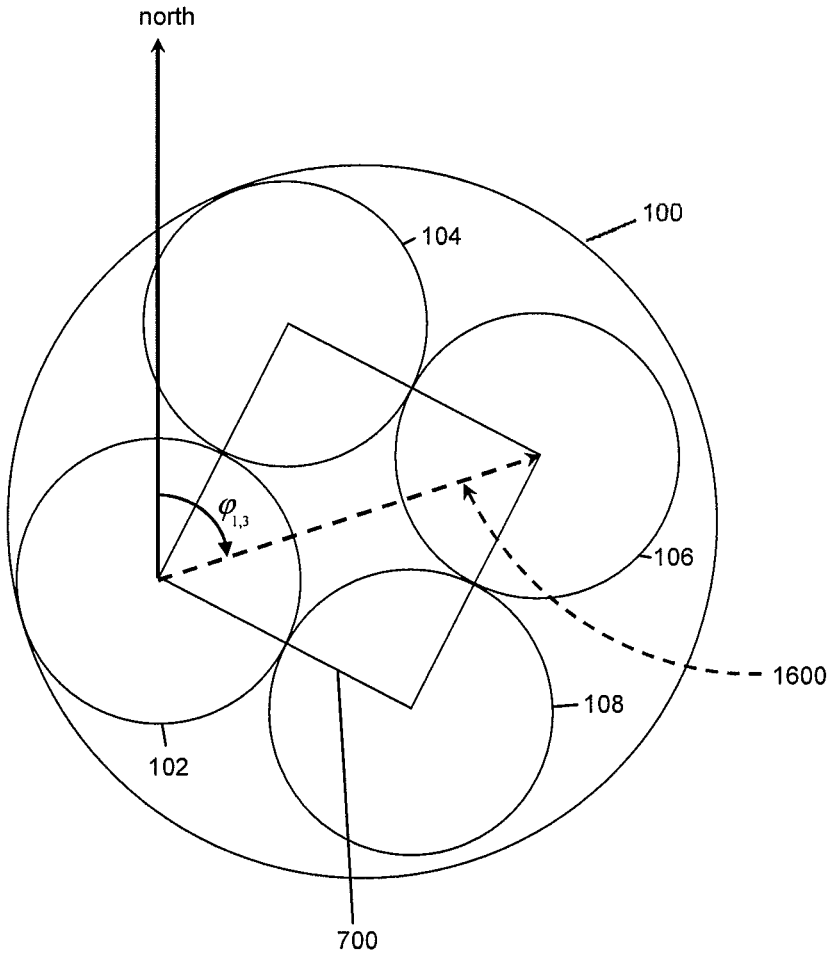
FIG. 16 schematically illustrates four wellbore casings within a wellbore conductor and a vector representing a relative orientation of the four wellbore casings in accordance with certain embodiments described herein.

In certain embodiments, the location of the center of a casing 102, 104, 106, 108 at a given depth or position x along the conductor 100 is specified in terms of north and east coordinates. The center-to-center separation between the ith and jth casings at position x is $$d_{i,j}(x)=\sqrt{(N_j(x)-N_i(x))^2+(E_j(x)-E_i(x))^2}, \quad \text{(Eq. 8)}$$

and the total center-to-center separation at position x is $$d(x)=d_{1,2}(x)+d_{2,3}(x)+d_{3,4}(x)+d_{4,1}(x), \quad \text{(Eq. 9)}$$

where $N_i(x)$ and $E_i(x)$ are the measured north and east coordinates of the ith casing at position x along the conductor 100 and where the first and third casings 102, 106 are on opposite vertices of the quadrilateral 700 and the second and fourth casings 104, 108 are on opposite vertices of the quadrilateral 700. As schematically illustrated in FIG. 16, the relative casing direction can be monitored by tracking the direction $\phi_{1,3}(x)$ of the (diagonal) vector 1600 from the first casing 102 to the third casing 106, with respect to a reference direction (e.g., north). Similarly, the relative casing direction can be monitored by tracking the direction $\phi_{2,4}(x)$ of the (diagonal) vector from the second casing 104 to the fourth casing 108, with respect to a reference direction (e.g., north). These directions are given by $$\varphi_{1,3}(x) = \arctan\left(\frac{E_3(x)-E_1(x)}{N_3(x)-N_1(x)}\right) \quad \text{(Eq. 10)}$$

and $$\varphi_{2,4}(x) = \arctan\left(\frac{E_4(x)-E_2(x)}{N_4(x)-N_2(x)}\right). \quad \text{(Eq. 11)}$$

As described above with respect to Equations (2) and (5), the terms of Equations (10) and (11) and/or the range of the arctangent function used therein may depend on the conventions used for the coordinate system, the angles, the reference direction, and/or the locations of the casings 102, 104, 106 in the conductor 100.

Application of Example Algorithm

As indicated above, in certain embodiments, there are at least two unguided wellbore casings within a wellbore conductor. In certain such embodiments, the following algorithm or one of the variants thereof described herein is used to determine at least one location of each of the two unguided wellbore casings within a wellbore conductor. Thus, for example, in some of the embodiments illustrated in FIG. 3, the method 200 comprises using the following algorithm or a variant thereof. Certain other embodiments make use of similar algorithms adapted for guided wellbore casings.

For purposes of the following description, the at least two wellbore casings may be referred to as casing a and casing b. In certain embodiments, sensor measurements are generated indicative of coordinates of the centers of the casings a and b at various depths or positions along the conductor. In certain such embodiments, the coordinates are north and east coordinates; the measurements generated for casing a are generated at substantially the same depths as they are for casing b; and these depths are substantially equally spaced along the conductor. In certain embodiments, these measurements are the principal inputs to the following algorithm. If there are n+1 location measurements for each casing generated at n+1 depths $x_0, x_1, \ldots, x_n$ along the conductor, then, for each i such that $0 \leqq i \leqq n$, the ith position $x_i$ can be referred to as station i, where the depth of the stations increases as i increases. The location of each of casings a and b at the initial depth $x_0$ (station 0) constitutes a reference point to which subsequent measurements are related. These inputs can be represented by an (n+1)×4 matrix C:

$$C = \begin{bmatrix} N_a(0) & E_a(0) & N_b(0) & E_b(0) \\ \vdots & \vdots & \vdots & \vdots \\ N_a(n) & E_a(n) & N_b(n) & E_b(n) \end{bmatrix}, \quad \text{(Eq. 12)}$$

where, for each i such that $0 \leqq i \leqq n$, $N_a(i)$ and $N_b(i)$ are the north coordinates of casings a and b at station i, respectively, and $E_a(i)$ and $E_b(i)$ are the east coordinates of casings a and b at station i, respectively, with station 0 being the hang-up point and station n being the last or lowest joint survey station. In some embodiments, the coordinates at station 0 are measured directly with high accuracy surface tools and can be considered error-free compared to the other coordinates, which are measured with downhole survey tools.

The fixed, starting or initial-depth casing-center-to-casing-center distance d(0) is given by $$d(0)=\sqrt{(N_b(0)-N_a(0))^2+(E_b(0)-E_a(0))^2}, \quad \text{(Eq. 13)}$$

and the casing-center-to-casing-center distance matrix d is given by $$d = \begin{bmatrix} d_{a,b}(1) \\ \vdots \\ d_{a,b}(n) \end{bmatrix}, \quad \text{(Eq. 14)}$$

where, for each i such that $1 \leqq i \leqq n$, $$d_{a,b}(i)=\sqrt{(N_b(i)-N_a(i))^2+(E_b(i)-E_a(i))^2}. \quad \text{(Eq. 15)}$$

If C is written as $C=(c_{i,j})$ (with $0 \leqq i \leqq n$ and $1 \leqq j \leqq 4$), then, for each i such that $1 \leqq i \leqq n$, the formula for $d_{a,b}(i)$ becomes $$d_{a,b}(i)=\sqrt{(c_{i,3}-c_{i,1})^2+(c_{i,4}-c_{i,2})^2}. \quad \text{(Eq. 16)}$$

Figure 17:
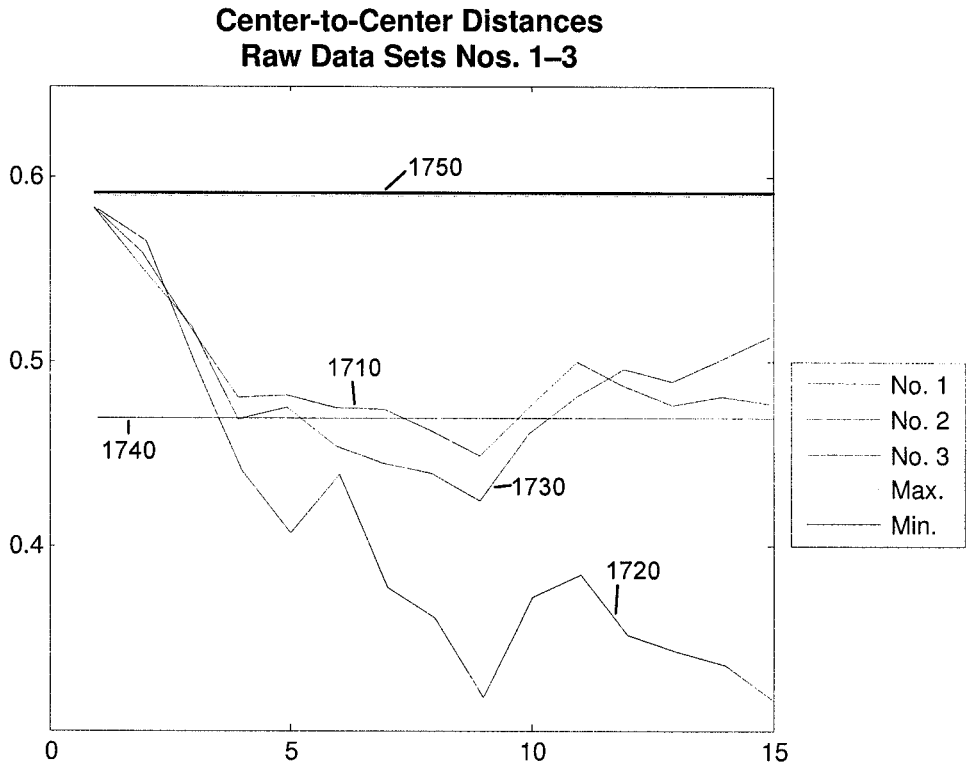
FIG. 17 contains example plots of center-to-center distance as a function of station number as calculated from three sets of raw sensor measurements.

FIG. 17 contains example plots of center-to-center distance as a function of station number (horizontal axis) for three sets of raw sensor measurements (reference numerals 1710, 1720, 1730). A first line 1740 indicates a minimum center-to-center distance and a second line 1750 indicates a maximum center-to-center distance. For each set of sensor measurements, the plot indicates that some sensor measurements in the set were generated that correspond to center-to-center distances lower than the minimum center-to-center distance, thus indicating that some of the sensor measurements were inaccurate.

The n distances $d_{a,b}(1), \ldots, d_{a,b}(n)$ are calculated from potentially erroneous coordinates and will accordingly be potentially erroneous. The errors in the calculated distances may cause the calculated distances to be inconsistent with the physical limitations on the true center-to-center distances imposed by the geometry of the conductor and/or the casings. For example, there is a nonzero minimum center-to-center distance because the casings cannot overlap, and there is a maximum center-to-center distance because the casings must remain in the conductor's interior. Thus, as indicated above, in certain embodiments, the algorithm utilizes geometric constraints on $d_{a,b}(i)$ for each i such that $1 \leqq i \leqq n$:

$$D_{min} \leqq d_{a,b}(i) \leqq D_{max}, \quad \text{(Eq. 17)}$$

where $D_{min}$ represents the minimum possible center-to-center distance and $D_{max}$ represents the maximum possible center-to-center distance. Methods of calculating $D_{min}$ and $D_{max}$ have been described above.

Certain standard least squares adjustment (LSA) techniques are generally designed to minimize the squared sum effect of residual errors by correcting individual input measurements. However, such methods are only available for unique constraints in the mathematical model of the system. In certain embodiments in which the casings are run into guided conductors, the geometric constraints used are known. In other embodiments, including embodiments in which the casings are unguided, the constraints are non-unique and therefore cannot be used directly with what might be considered "standard" LSA techniques. In these embodiments, this problem can be overcome by utilizing the statistical expectation of $d_{a,b}(i)$, denoted $e(d_{a,b}(i))$, which, in certain such embodiments is a good estimate for the true center-to-center distance. In certain such embodiments, due to the elastic properties of the two casings, $e(d_{a,b}(i))$ can be described as a continuous and differentiable function $f_{d_{a,b}}(x)$ of position x along the conductor. Thus, in some embodiments, the n non-unique geometric constraints can be used to generate n apparent constraints with unique geometric properties:

$$e(d_{a,b}(i)) = f_{d_{a,b}}(x_i) \quad \text{(Eq. 18)}$$

where $1 \leqq i \leqq n$ and, as above, $x_i$ denotes station i. As previously indicated, in certain embodiments, generating these unique geometric constraints allows certain LSA techniques to be used.

In certain embodiments, the function $f_{d_{a,b}}(x)$ must be selected or determined. In certain such embodiments, there are several candidates for $f_{d_{a,b}}(x)$ and it is not readily apparent which one provides or which ones provide a true or best description of $e(d_{a,b}(i))$. In certain embodiments, however, $D_{max}-D_{min}$, which is the size of the range of possible values for the center-to-center distance, will be small relative to the survey uncertainty (even with state-of-the-art survey technology). In certain such embodiments, this fact about the relative sizes of $D_{max}-D_{min}$ and the survey uncertainty advantageously implies that it is not necessary to select or determine a candidate function that provides a true or best description of $e(d_{a,b}(i))$. In certain such embodiments, any differentiable function fulfilling the original constraints (i.e., that $f_{d_{a,b}}(i)=d(0)$ for each i such that $1 \leqq i \leqq n$) will be adequate to establish the trend in the center-to-center orientation with sufficient accuracy. Nonetheless, a function that provides a realistic physical model is advantageously used. Due to gravitational effects, the realism of the model provided by the function will depend to a large degree on the conductor orientation.

Thus, certain embodiments involving an LSA technique use a model of the center-to-center distance between casings a and b. In certain such embodiments, a model in which the center-to-center distance is constant is unlikely to be suitable unless the casings are free-hanging and parallel, which only occurs in relatively few cases. In certain embodiments, a more sophisticated mathematical model is advantageously used for the more likely situation in which the conductor is not precisely vertical and the two casings are expected to follow a catenary curve downwards until they reach the conductor's lower side and then rest on the lower side for the remaining distance along the conductor. In certain such embodiments, a continuous model that is differentiable at the position along the conductor at which the casings touch one another and/or reach the lower side of the conductor (the "meeting point") and whose first order derivative at that position is continuous is advantageously used. For example, in certain embodiments, if the model is a piecewise function indicating a constant center-to-center distance at and below the meeting point, the model advantageously indicates a center-to-center distance above the meeting point that is defined by a quadratic expression whose graph is a parabola reaching a minimum at the meeting point. The quadratic expression thus has a first order derivative equal to zero at the meeting point, which coincides with the first order derivative of a constant function, meaning that the piecewise function has a continuous first order derivative at the meeting point equal to zero. The quadratic portion of such a model also advantageously is a reasonable approximation of the catenary curve the casings are expected to follow initially. For short or moderate arc lengths, this advantageously implies that the quadratic is a reasonable approximation of the center-to-center distance as the casings initially follow the expected catenary trajectories. Thus, in certain embodiments, the center-to-center distance is modeled with the aid of the following function or mapping:

$$f_{d_{a,b}}(x) = \begin{cases} D_{min} + K(t-x)^2 & \text{if } 0 < x < \tau \\ D_{min} & \text{if } \tau \leq x < x_n \end{cases} \quad \text{(Eq. 19)}$$

where x is position along the conductor scaled in terms of station numbers (i.e., x is position along the conductor in a given unit (e.g., meters) divided by the distance (e.g., in meters) between successive survey stations); t is the unknown position along the conductor in terms of station numbers of the meeting point; $\tau$ is the number of the station nearest to t; and K is an unknown proportionality factor.

Figure 18:
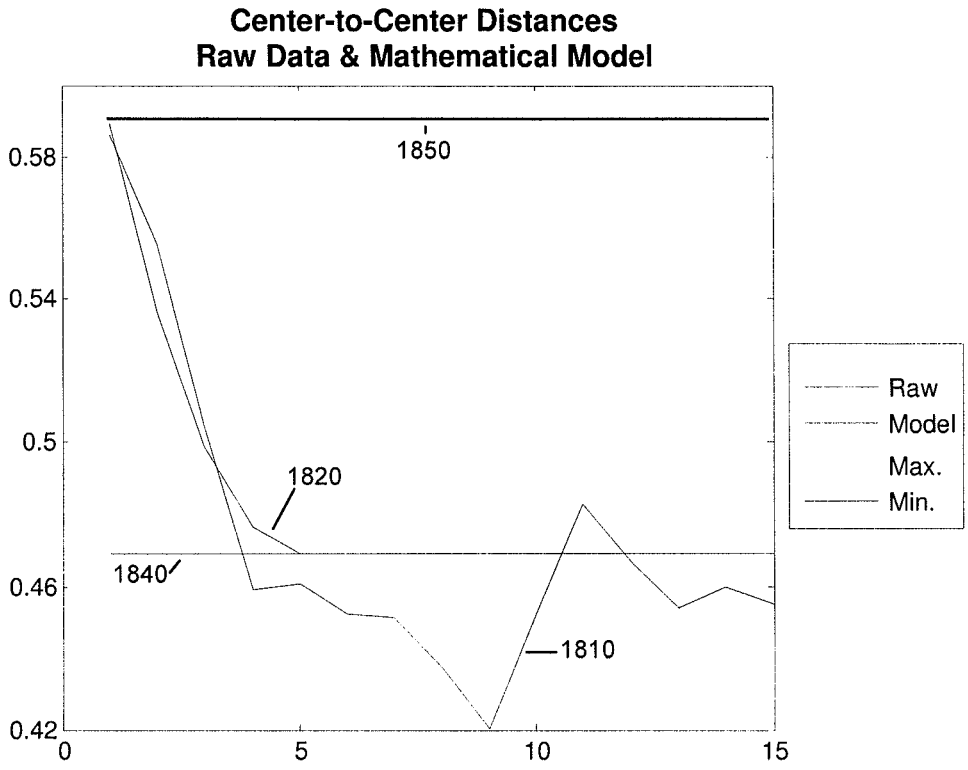
FIG. 18 contains example plots of center-to-center distance as a function of station number as calculated from one set of raw sensor measurements and as defined by a mathematical model of center-to-center distance.

FIG. 18 contains example plots of center-to-center distance 1810 as a function of station number (horizontal axis) as calculated from one set of raw sensor measurements and center-to-center distance 1820 as defined by the mathematical model of center-to-center distance given by Equation (19), with $\tau$ set equal to 5. A first line 1840 indicates a minimum center-to-center distance and a second line 1850 indicates a maximum center-to-center distance.

In certain embodiments, the magnitude of typical survey errors is large enough to mask the trend of the center-to-center distance. In certain such embodiments, signal-to-noise ratio is improved before the center-to-center model is derived.

Analysis of the most significant survey errors has indicated a linear, depth-dependent trend as predominant. Therefore, in certain such embodiments, the signal-to-noise ratio is improved by estimating the contribution made by survey errors to the center-to-center distance calculations and correcting for them. In certain such embodiments, a high degree in precision is not needed in this process, and, in some of these embodiments, it will be sufficient to rotate the center-to-center distance graph around the fixed initial d(0) so that the distance at the last station (i=n) becomes equal to the minimum allowed distance ($D_{min}$). A physical model of the center-to-center distance with sufficient accuracy to serve as a starting point for a later LSA process is then established in certain embodiments through the following procedure:

(a) Calculate the apparent linear distance drift, Θ, at the bottom:

$$\Theta = \frac{d_{a,b}(n) - d(0)}{n}. \quad \text{(Eq. 20)}$$

(b) Remove the apparent linear drift for all center-to-center distances: set $$\Theta_0 = \frac{D_{min} - d(0)}{n} \quad \text{(Eq. 21)}$$

and for each i such that 1≦i≦n, update $d_{a,b}(i)$ to be $$d_{a,b}(i) \leftarrow d_{a,b}(i) - i(\Theta - \Theta_0). \quad \text{(Exp. 22)}$$

(c) Set τ to be a value of i that gives a least value of $d_{a,b}(i)$, i.e., set τ to be such that $d_{a,b}(\tau) = \min\{d_{a,b}(i) | 1 \leqq i \leqq n\}$.

(d) Set t equal to τ as an initial value or initial estimate of the meeting point.

(e) Calculate an initial value or initial estimate of the proportionality factor K. In certain embodiments, the initial estimate of K is calculated using a regression-like expression. For example, in certain such embodiments the following expression is used:

$$K = \frac{nt^2(d(0) - D_{min}) + \sum_{i=1}^{t}(t-i)^2(d_{a,b}(i) - D_{min})}{nt^4 + \sum_{i=1}^{t}(t-i)^4}. \quad \text{(Eq. 23)}$$

(f) Check that the assumptions about the model are correct. For example, verify that $D_{min} \leqq d_{a,b}(\tau) < d(0)$ and that τ≧2.

Figure 19:
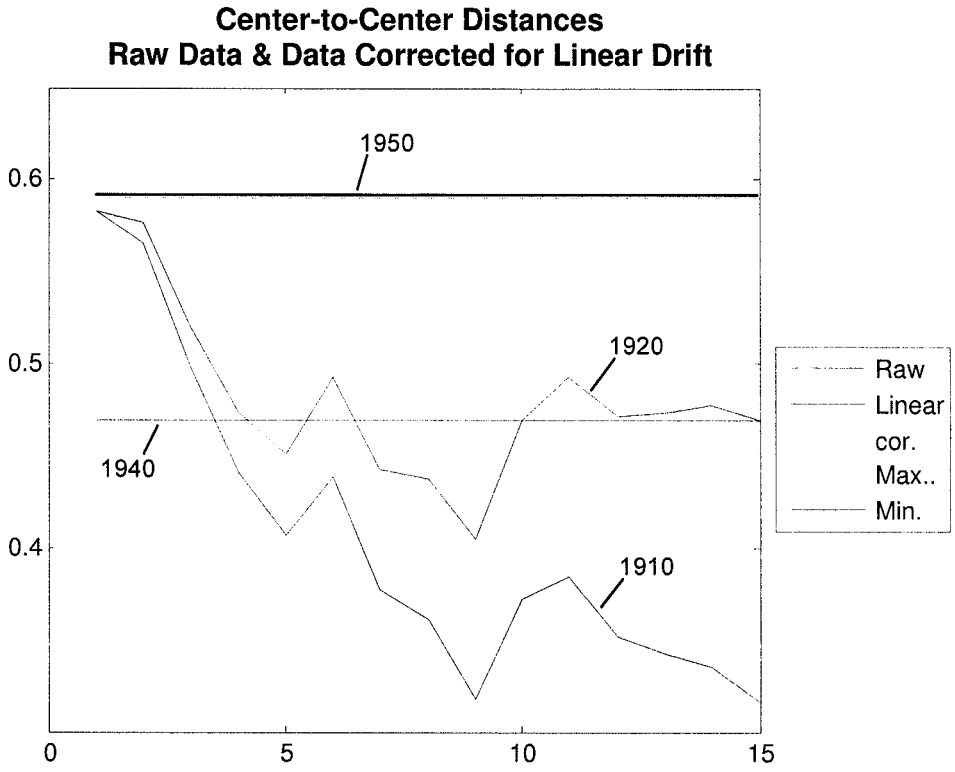
FIG. 19 contains example plots of center-to-center distance as a function of station number as calculated from one set of raw sensor measurements and as calculated after linear drift removal in accordance with certain embodiments described herein.

FIG. 19 contains example plots of center-to-center distance 1910 as a function of station number (horizontal axis) as calculated from raw sensor measurements and center-to-center distance 1920 as calculated after linear drift removal. A first line 1940 indicates a minimum center-to-center distance and a second line 1950 indicates a maximum center-to-center distance.

Once steps are thus taken to improve signal-to-noise ratio, n apparent constraints for use with LSA techniques are given by:

$$e(d_{a,b}(i)) = D_{min} + K(t-i)^2, \text{ for i such that } 1 \leqq i \leqq \tau, \quad \text{(Eq. 24)}$$

$$e(d_{a,b}(i)) = D_{min}, \text{ for i such that } \tau \leqq i \leqq n, \text{ and} \quad \text{(Eq. 25)}$$

$$d(0) = D_{min} + Kt^2, \quad \text{(Eq. 26)}$$

where $e(d_{a,b}(i))$ is the expectation of $d_{a,b}(i)$ and t and K are unknowns.

The relationship between t and K is nonlinear. In certain embodiments, a linearization is performed to create an equation system to be used in conjunction with LSA techniques. In certain such embodiments, the fundamental linearized equation system, in matrix form, can be written as:

$$e(d) = -A \cdot X - F. \quad \text{(Eq. 27)}$$

The right-hand side of Equation (27) is derived from the apparent constraints; in particular, $$X = \begin{bmatrix} \delta_t \\ \delta_k \end{bmatrix}, \quad \text{(Eq. 28)}$$

A is an (n+1)×2 matrix, with $$A = \begin{bmatrix} -2K(t-1) & -(t-1)^2 \\ \vdots & \vdots \\ -2K(t-\tau) & -(t-\tau)^2 \\ 0 & 0 \\ \vdots & \vdots \\ 0 & 0 \\ -2Kt & -t^2 \end{bmatrix}, \text{ and} \quad \text{(Eq. 29)}$$

F is an (n+1)×1 matrix, with $$F = \begin{bmatrix} -D_{min} - K(t-1)^2 \\ \vdots \\ -D_{min} - K(t-\tau)^2 \\ -D_{min} \\ \vdots \\ -D_{min} \\ -D_{min} - Kt^2 \end{bmatrix}. \quad \text{(Eq. 30)}$$

The left-hand side of Equation (27) involves the expectation of the center-to-center distances. In certain embodiments, these distance values are less appropriate as inputs to LSA techniques due to significant but unknown station-to-station correlation effects. In certain such embodiments, these values are easily converted into differences between the center-to-center distances at consecutive stations, which are less correlated. For example, in certain such embodiments, the following coordinate-based differences are defined: for each i such that 1≦i≦n:

$$\delta_1(i) = N_a(i) - N_a(i-1) = c_{i,1} - c_{i-1,1}; \quad \text{(Eq. 31)}$$

$$\delta_2(i) = N_b(i) - N_b(i-1) = c_{i,3} - c_{i-1,3}; \quad \text{(Eq. 32)}$$

$$\delta_3(i) = E_a(i) - E_a(i-1) = c_{i,2} - c_{i-1,2}; \text{ and} \quad \text{(Eq. 33)}$$

$$\delta_4(i) = E_b(i) - E_b(i-1) = c_{i,4} - c_{i-1,4}. \quad \text{(Eq. 34)}$$

Then, in such embodiments, the $d_{a,b}(i)$ are replaced with d(i) as the basis for input to an LSA technique, where for each i such that 1≦i≦n, $$d(i) = \left(\left(\left(c_{i,1} + \sum_{j=1}^{i}\delta_1(j)\right) - \left(c_{i,3} + \sum_{j=1}^{i}\delta_2(j)\right)\right)^2 + \left(\left(c_{i,2} + \sum_{j=1}^{i}\delta_3(j)\right) - \left(c_{i,4} + \sum_{j=1}^{i}\delta_4(j)\right)\right)^2\right)^{\frac{1}{2}}. \quad \text{(Eq. 35)}$$

Then, for each i such that $1 \leqq i \leqq n$, $$e(d(i)) = \left(\left(\left(c_{i,1} + \sum_{j=1}^{i} \delta_1(j) + \sum_{j=1}^{i} \varepsilon_1(j)\right) - \left(c_{i,3} + \sum_{j=1}^{i} \delta_2(j) + \sum_{j=1}^{i} \varepsilon_2(j)\right)\right)^2 + \left(\left(c_{i,2} + \sum_{j=1}^{i} \delta_3(j) + \sum_{j=1}^{i} \varepsilon_3(j)\right) - \left(c_{i,4} + \sum_{j=1}^{i} \delta_4(j) + \sum_{j=1}^{i} \varepsilon_4(j)\right)\right)^2\right)^{\frac{1}{2}} \quad \text{(Eq. 36)}$$

for some error terms $\epsilon_k(j)$.

These center-to-center distance expectation expressions are non-linear. Therefore, in certain embodiments, these expressions will also be linearized. In certain such embodiments, this linearization can be written as:

$$e(d)=B\cdot\epsilon+M, \quad \text{(Eq. 37)}$$

where $$\epsilon=[\epsilon_1(1) \ldots \epsilon_1(n)\epsilon_2(1) \ldots \epsilon_2(n)\epsilon_3(1) \ldots \epsilon_3(n)\epsilon_4(1) \ldots \epsilon_4(n)]^T, \quad \text{(Eq. 38)}$$

with $^T$ denoting the matrix transpose operation, $$M = \begin{bmatrix} d_{a,b}(1) \\ \vdots \\ d_{a,b}(n) \end{bmatrix}, \quad \text{(Eq. 39)}$$

and where B is an n×4n matrix composed of four lower triangular n×n submatrices: in particular, $$B = [B_{N_a} \mid B_{N_b} \mid B_{E_a} \mid B_{E_b}], \quad \text{(Eq. 40)}$$

where $$B_{N_a} = \begin{bmatrix} \frac{c_{1,1}-c_{1,3}}{d_{a,b}(1)} & 0 & \cdots & \cdots & \cdots & 0 \\ \frac{c_{1,1}-c_{1,3}}{d_{a,b}(2)} & \frac{c_{2,1}-c_{2,3}}{d_{a,b}(2)} & 0 & \cdots & \cdots & 0 \\ \frac{c_{1,1}-c_{1,3}}{d_{a,b}(3)} & \frac{c_{2,1}-c_{2,3}}{d_{a,b}(3)} & \frac{c_{3,1}-c_{3,3}}{d_{a,b}(3)} & 0 & \cdots & 0 \\ \vdots & \vdots & \vdots & \ddots & \ddots & \vdots \\ \frac{c_{1,1}-c_{1,3}}{d_{a,b}(n-1)} & \frac{c_{2,1}-c_{2,3}}{d_{a,b}(n-1)} & \frac{c_{3,1}-c_{3,3}}{d_{a,b}(n-1)} & \cdots & \frac{n_{n-1,1}-c_{n-1,3}}{d_{a,b}(n-1)} & 0 \\ \frac{c_{1,1}-c_{1,3}}{d_{a,b}(n)} & \frac{c_{2,1}-c_{2,3}}{d_{a,b}(n)} & \frac{c_{3,1}-c_{3,3}}{d_{a,b}(n)} & \cdots & \frac{c_{n-1,1}-c_{n-1,3}}{d_{a,b}(n)} & \frac{c_{n,1}-c_{n,3}}{d_{a,b}(n)} \end{bmatrix}, \quad \text{(Eq. 41)}$$

$$B_{N_b} = -B_{N_a}, \quad \text{(Eq. 42)}$$

$$B_{E_a} = \begin{bmatrix} \frac{c_{1,2}-c_{1,4}}{d_{a,b}(1)} & 0 & \cdots & \cdots & \cdots & 0 \\ \frac{c_{1,3}-c_{1,4}}{d_{a,b}(2)} & \frac{c_{2,3}-c_{2,4}}{d_{a,b}(2)} & 0 & \cdots & \cdots & 0 \\ \frac{c_{1,2}-c_{1,4}}{d_{a,b}(3)} & \frac{c_{2,2}-c_{2,4}}{d_{a,b}(3)} & \frac{c_{3,2}-c_{3,4}}{d_{a,b}(3)} & 0 & \cdots & 0 \\ \vdots & \vdots & \vdots & \ddots & \ddots & \vdots \\ \frac{c_{1,2}-c_{1,4}}{d_{a,b}(n-1)} & \frac{c_{2,2}-c_{2,3}}{d_{a,b}(n-1)} & \frac{c_{3,2}-c_{3,4}}{d_{a,b}(n-1)} & \cdots & \frac{n_{n-1,2}-c_{n-1,4}}{d_{a,b}(n-1)} & 0 \\ \frac{c_{1,2}-c_{1,4}}{d_{a,b}(n)} & \frac{c_{2,2}-c_{2,4}}{d_{a,b}(n)} & \frac{c_{3,2}-c_{3,4}}{d_{a,b}(n)} & \cdots & \frac{c_{n-1,2}-c_{n-1,4}}{d_{a,b}(n)} & \frac{c_{n,2}-c_{n,4}}{d_{a,b}(n)} \end{bmatrix}, \quad \text{(Eq. 43)}$$

and $B_{E_b} = -B_{E_a}$. (Eq. 44)

Setting G=M+F and combining Equation (37) with Equation (27) yields:

$$B\cdot\epsilon+A\cdot X+G=0. \quad \text{(Eq. 45)}$$

Equation system (45) is a redundant system, which can be solved with LSA methods. Advantageously, the "correlate with element adjustment" LSA method is used; this LSA technique is described in detail in several references, including Wells, D. E. & Krakiwsky, E. J., "The Method of Least Squares," Lecture Notes Vol. 18 (Department of Geodesy and Geomatics Engineering, University of New Brunswick, May 1971, latest reprinting February 1997), particularly pages 113-116, the entirety of which is hereby incorporated by reference.

The correlate with element adjustment technique includes iterations to compensate for imperfection in the linearization process. In certain embodiments, certain steps are iterated until convergence is reached for a value of t, the meeting point. For example, in certain embodiments the following steps are iterated as described below until convergence is reached:

(1) Calculate initial values for K, τ and t as described above in steps (a) through (f).

(2) Calculate matrices A, B and G as described above, including Equations (29), (30), (39) and (40).

(3) Set $$\beta=B\cdot B^T. \quad \text{(Eq. 46)}$$

(4) Set $$\chi=\beta^{-1}\cdot G. \quad \text{(Eq. 47)}$$

(5) Set $$\epsilon=B^T\cdot\chi. \quad \text{(Eq. 48)}$$

(6) For each i such that $1 \leqq i \leqq n$ and for each k such that $1 \leqq k \leqq 4$, update values as follows:

$$\delta_k(i) \leftarrow \delta_k(i) + \epsilon_k(i), \quad \text{(Exp. 49)}$$

where $$\epsilon = [\epsilon_1(1) \ldots \epsilon_1(n) \epsilon_2(1) \ldots \epsilon_2(n) \epsilon_3(1) \ldots \epsilon_3(n) \epsilon_4(1) \ldots \epsilon_4(n)]^T. \quad \text{(Eq. 50)}$$

(7) Update $C = (c_{i,j})$ (with $0 \leqq i \leqq n$ and $1 \leqq j \leqq 4$) as follows: for each i such that $1 \leqq i < n$, $$c_{i+1,1} \leftarrow c_{i,1} + \delta_1(i), \quad \text{(Exp. 51)}$$

$$c_{i+1,2} \leftarrow c_{i,2} + \delta_3(i), \quad \text{(Exp. 52)}$$

$$c_{i+1,3} \leftarrow c_{i,3} + \delta_2(i), \text{ and} \quad \text{(Exp. 53)}$$

$$c_{i+1,4} \leftarrow c_{i,4} + \delta_4(i). \quad \text{(Exp. 54)}$$

(8) Generate updated values of K, $\tau$ and t using steps (a) through (f) above and using the updated matrix C.

(9) If the updated value of $\tau$ obtained in the previous step is different from the value of $\tau$ in the previous iteration (or in step (1) if there was no previous iteration), repeat steps (2) through (9).

In certain embodiments, once convergence has been reached for $\tau$ and, thus, an initial value of t, the following steps are iterated as described below until convergence is reached:

(10) Update matrices A, B and G by recalculating these matrices as described above, including Equations (29), (30), (39) and (40), but using the updated parameters K, $\tau$ and t and updated matrix C.

(11) Set $$\gamma = B \cdot B^T. \quad \text{(Eq. 55)}$$

(12) Set $$\alpha = \left[\begin{array}{c|c} \gamma & A \\ \hline A^T & 0_{2\times 2} \end{array}\right]; \quad \text{(Eq. 56)}$$

that is, let $\alpha$ be a $(n+2)\times(n+2)$ matrix with submatrices $\gamma$, A, the transpose of A, and the $2\times 2$ zero matrix as arranged above.

(13) Set $$\eta = [G^T | 00]^T. \quad \text{(Eq. 57)}$$

(14) Set $$\kappa = \alpha^{-1} \cdot \eta. \quad \text{(Eq. 58)}$$

(15) Write $\kappa = (\kappa_i)$ (with $1 \leqq i \leqq n+2$). Set $$\lambda = \begin{bmatrix} \kappa_1 \\ \kappa_2 \\ \vdots \\ \kappa_{n+1} \\ \kappa_{n+2} \end{bmatrix}. \quad \text{(Eq. 59)}$$

(16) Updates $\epsilon$ by settings $\epsilon \leftarrow B^T \cdot \lambda$.

(17) Update values as set forth in step (6).

(18) Update values as set forth in step (7).

(19) Update values by setting $K \leftarrow \kappa_{n+2}$ and $t \leftarrow \kappa_{n+1}$.

(20) Update $\tau$ to be the nearest integer (station number) j to t such that $1 < j \leqq n$.

(21) If $\max(\epsilon)$ (i.e., the maximum value among the entries in the matrix $\epsilon$) is greater than a predetermined update tolerance, repeat steps (10) through (21).

(22) Calculate the center-to-center separation and direction (azimuth) using the latest values of the matrix C.

Figure 20:
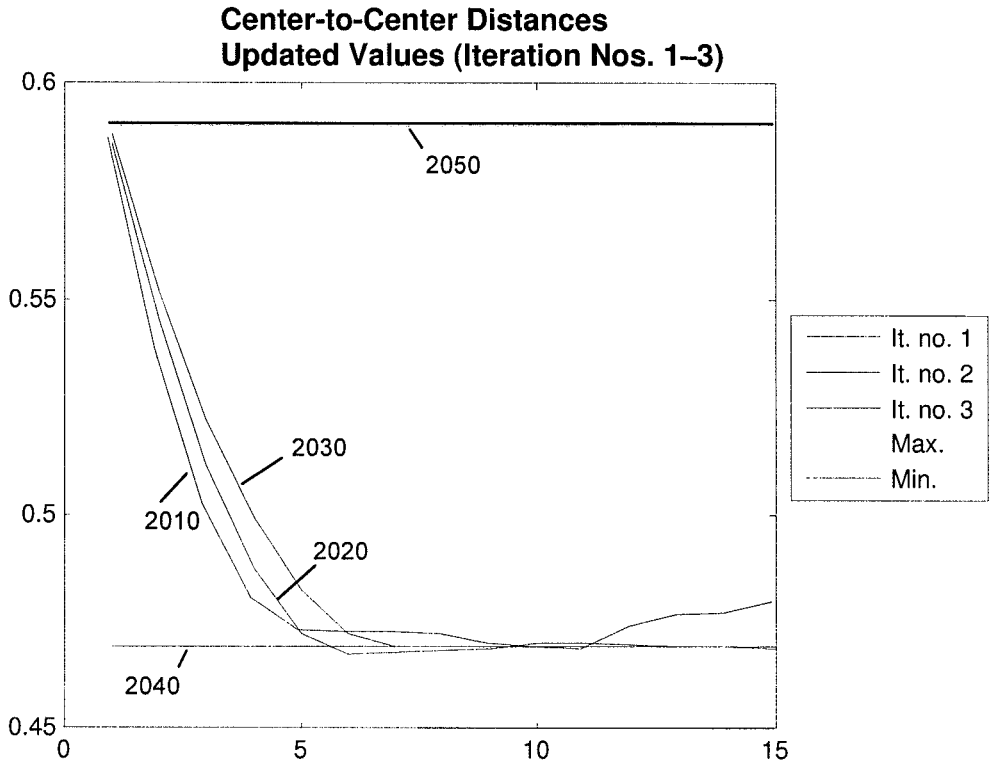
FIG. 20 contains example plots of center-to-center distance as a function of station number for various iterations in a least squares adjustment technique in accordance with certain embodiments described herein.

FIG. 20 contains example plots of center-to-center distance as a function of station number (horizontal axis) for various iterations in an LSA technique such as the one described above (reference numerals 2010, 2020, 2030). A first line 2040 indicates a minimum center-to-center distance and a second line 2050 indicates a maximum center-to-center distance. In the third iteration 2030 plotted in FIG. 20, the center-to-center distance does not fall below the minimum distance, or, if it does, it does not do so by a significant amount.

Figure 21:
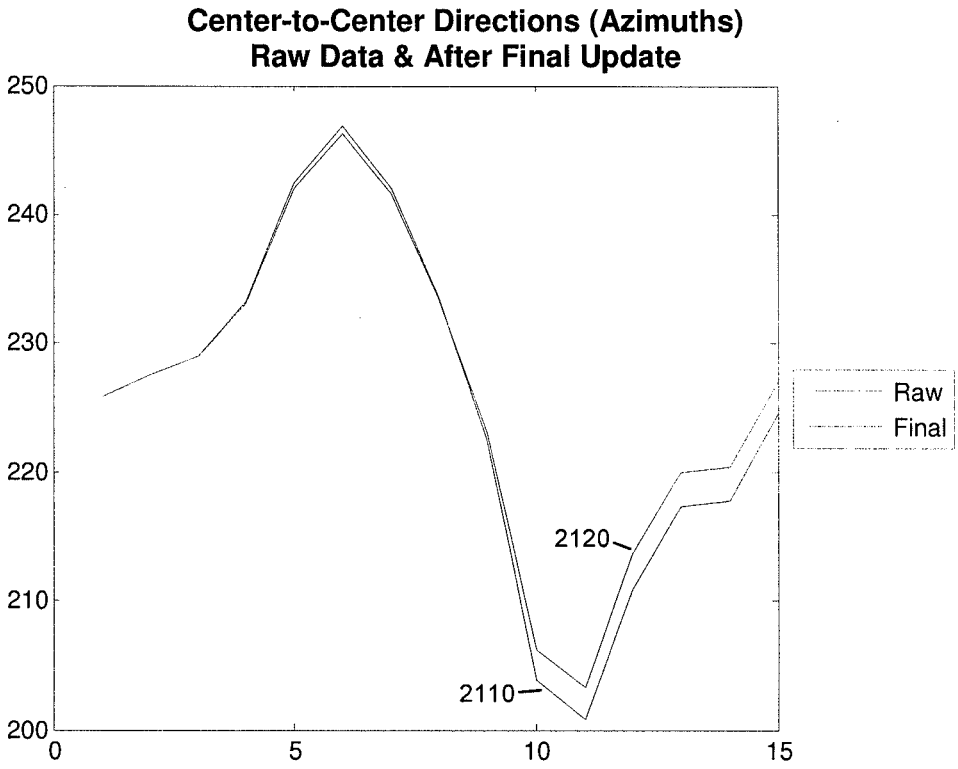
FIG. 21 contains example plots of center-to-center directions (azimuths) as a function of station number as calculated from one set of raw sensor measurements and as calculated from the final set of updated data generated by a least squares adjustment in accordance with certain embodiments described herein.

FIG. 21 contains example plots of center-to-center directions (azimuths) 2110 as a function of station number (horizontal axis) calculated from one set of raw sensor measurements and center-to-center directions 2120 calculated from the final set of updated data generated by an LSA technique such as the one described above.

Each of the processes, components, and algorithms described above can be embodied in, and fully automated by, code modules executed by one or more computers or computer processors. The code modules can be stored on any type of computer-readable medium or computer storage device. The processes and algorithms can also be implemented partially or wholly in application-specific circuitry. The results of the disclosed processes and process steps can be stored, persistently or otherwise, in any type of computer storage. In one embodiment, the code modules can advantageously execute on one or more processors. In addition, the code modules can include, but are not limited to, any of the following: software or hardware components such as software object-oriented software components, class components and task components, processes methods, functions, attributes, procedures, subroutines, segments of program code, drivers, firmware, microcode, circuitry, data, databases, data structures, tables, arrays, variables, or the like.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined in the appended claims.

What is claimed is:

1. A method of determining at least one location of at least one wellbore casing within a wellbore conductor, the method comprising:

providing sensor measurements generated by at least one sensor within the wellbore conductor, the sensor measurements indicative of at least one location of the at least one wellbore casing within the wellbore conductor as a function of position along the wellbore conductor; and calculating, using a processor, the at least one location of the at least one wellbore casing using the sensor measurements and at least one geometric constraint, the at least one geometric constraint originating at least in part from at least one physical parameter of the wellbore conductor, or at least one physical parameter of the at least one wellbore casing, or both, wherein the at least one wellbore casing comprises a first wellbore casing and a second wellbore casing, wherein calculating the at least one location of the at least one wellbore casing comprises:

estimating, based at least in part on the at least one geometric constraint and the sensor measurements, a position along the wellbore conductor at which the first and second wellbore casings touch one another; and using the estimated position to calculate locations of the first and second wellbore casings, wherein estimating the position comprises:

using the sensor measurements to calculate an initial value of a quantity t representing the position;

calculating an initial value of a proportionality factor K; and using a mapping to at least approximate the distance between the first and second wellbore casings as a function of position along the wellbore conductor, the mapping at least in part defined by an expression dependent at least in part on the quantity t, the proportionality factor K, and the at least one geometric constraint.

2. The method of claim 1, wherein the at least one physical parameter comprises a cross-sectional dimension of the at least one wellbore casing.

3. The method of claim 2, wherein the cross-sectional dimension is a diameter or perimeter of a cross section of the at least one wellbore casing.

4. The method of claim 1, wherein the at least one physical parameter comprises a cross-sectional dimension of the wellbore conductor.

5. The method of claim 4, wherein the cross-sectional dimension is a diameter or perimeter of a cross section of the wellbore conductor.

6. The method of claim 1, wherein the at least one geometric constraint comprises a maximum distance between the first and second wellbore casings.

7. The method of claim 6, wherein the maximum distance between the first and second wellbore casings is a maximum distance between centers of the first and second wellbore casings.

8. The method of claim 1, wherein the at least one geometric constraint comprises a minimum distance between the first and second wellbore casings.

9. The method of claim 8, wherein the minimum distance between the first and second wellbore casings is a minimum distance between centers of the first and second wellbore casings.

10. The method of claim 1, wherein the at least one wellbore casing further comprises a third wellbore casing and the at least one geometric constraint comprises a vector representing a relative orientation of the first, second, and third wellbore casings.

11. The method of claim 1, wherein the expression is a quadratic expression.

12. The method of claim 1, wherein using the sensor measurements to calculate an initial value of the quantity t comprises:

calculating an apparent linear drift of the first and second wellbore casings relative to one another; and using the apparent linear drift to calculate an initial value of t representative of an estimated position along the wellbore conductor at which the first and second wellbore casings touch one another.

13. The method of claim 1, wherein estimating the position further comprises:

determining a system of linear equations based at least in part on the mapping; and (a) calculating at least one updated value of t, wherein calculating the at least one updated value of t the comprises:

using the system of linear equations to calculate a set of values indicative of updated estimates of the locations of the first and second wellbore casings as a function of position along the wellbore conductor; and calculating updated estimates of t and K using the set of values.

14. The method of claim 13, wherein estimating the position further comprises:

updating the system of linear equations based at least in part on the updated estimates of t and K; and repeating (a).

15. The method of claim 13, wherein estimating the position further comprises:

updating the system of linear equations based at least in part on the updated estimates of t and K;

comparing sequential calculations of at least one of t, K, and the linear equations to determine whether convergence of a value of t is reached; and repeating (a) only if convergence is not reached.

16. The method of claim 1, wherein using the estimated position to calculate locations of the first and second wellbore casings comprises:

(b) using the estimated position to estimate the locations of the first and second wellbore casings;

determining whether the estimated locations have a margin of error within a predetermined tolerance; and repeating (b) only if the estimated locations do not have a margin of error within the tolerance.

17. The method of claim 1, wherein calculating the at least one location of the at least one wellbore casing comprises using a least squares adjustment.

18. The method of claim 1, wherein providing sensor measurements comprises checking the sensor measurements for gross errors and using the sensor measurements comprises using only sensor measurements that are free from gross errors.

19. A system for determining at least one location of at least one wellbore casing within a wellbore conductor, the system comprising:

a data memory that stores sensor measurements corresponding to measurements from at least one sensor within the wellbore conductor, the sensor measurements indicative of at least one location of the at least one wellbore casing within the wellbore conductor as a function of position along the wellbore conductor; and a computer system in communication with the data memory, the computer system operative to calculate the at least one location of the at least one wellbore casing using the sensor measurements and at least one geometric constraint, the at least one geometric constraint originating at least in part from at least one physical parameter of the wellbore conductor, or at least one physical parameter of the at least one wellbore casing, or both, wherein the at least one wellbore casing comprises a first wellbore casing and a second wellbore casing, wherein calculating the at least one location of the at least one wellbore casing comprises:

estimating, based at least in part on the at least one geometric constraint and the sensor measurements, a position along the wellbore conductor at which the first and second wellbore casings touch one another; and using the estimated position to calculate locations of the first and second wellbore casings, wherein estimating the position comprises:

using the sensor measurements to calculate an initial value of a quantity t representing the position;

calculating an initial value of a proportionality factor K; and using a mapping to at least approximate the distance between the first and second wellbore casings as a function of position along the wellbore conductor, the mapping at least in part defined by an expression dependent at least in part on the quantity t, the proportionality factor K, and the at least one geometric constraint.

20. A system for determining at least one location of at least one wellbore casing within a wellbore conductor, the system comprising:

a first component that provides sensor measurements corresponding to measurements from at least one sensor within the wellbore conductor, the sensor measurements indicative of at least one location of the at least one wellbore casing within the wellbore conductor as a function of position along the wellbore conductor;

a second component that calculates the at least one location of the at least one wellbore casing using the sensor measurements and at least one geometric constraint, the at least one geometric constraint originating at least in part from at least one physical parameter of the wellbore conductor, or at least one physical parameter of the at least one wellbore casing, or both; and a computer operative to execute the first and second components, wherein the at least one wellbore casing comprises a first wellbore casing and a second wellbore casing, wherein calculating the at least one location of the at least one wellbore casing comprises:

estimating, based at least in part on the at least one geometric constraint and the sensor measurements, a position along the wellbore conductor at which the first and second wellbore casings touch one another; and using the estimated position to calculate locations of the first and second wellbore casings, wherein estimating the position comprises:

using the sensor measurements to calculate an initial value of a quantity t representing the position;

calculating an initial value of a proportionality factor K; and using a mapping to at least approximate the distance between the first and second wellbore casings as a function of position along the wellbore conductor, the mapping at least in part defined by an expression dependent at least in part on the quantity t, the proportionality factor K, and the at least one geometric constraint.

21. A non-transitory computer-readable medium having computer-executable components, executed on a computer system having at least one computing device, for determining at least one location of at least one wellbore casing within a wellbore conductor, the computer-executable components comprising:

a first component that provides sensor measurements corresponding to measurements from at least one sensor within the wellbore conductor, the sensor measurements indicative of at least one location of the at least one wellbore casing within the wellbore conductor as a function of position along the wellbore conductor; and a second component that calculates the at least one location of the at least one wellbore casing using the sensor measurements and at least one geometric constraint, the at least one geometric constraint originating at least in part from at least one physical parameter of the wellbore conductor, or at least one physical parameter of the at least one wellbore casing, or both, wherein the at least one wellbore casing comprises a first wellbore casing and a second wellbore casing, wherein calculating the at least one location of the at least one wellbore casing comprises:

estimating, based at least in part on the at least one geometric constraint and the sensor measurements, a position along the wellbore conductor at which the first and second wellbore casings touch one another; and using the estimated position to calculate locations of the first and second wellbore casings, wherein estimating the position comprises:

using the sensor measurements to calculate an initial value of a quantity t representing the position;

calculating an initial value of a proportionality factor K; and using a mapping to at least approximate the distance between the first and second wellbore casings as a function of position along the wellbore conductor, the mapping at least in part defined by an expression dependent at least in part on the quantity t, the proportionality factor K, and the at least one geometric constraint.

* * * * *

UNITED STATES PATENT AND TRADEMARK OFFICE

CERTIFICATE OF CORRECTION

PATENT NO. : 8,457,896 B2
APPLICATION NO. : 12/564812
DATED : June 4, 2013
INVENTOR(S) : Roger Ekseth It is certified that error appears in the above-identified patent and that said Letters Patent is hereby corrected as shown below:

In the Specification

In column 12 at line 52, Change "$\alpha_{3.1}$" to --$\alpha_{3,1}$--.

In column 12 at line 53, Change "$\beta_1(x)=\alpha_{3.1}(x)-\alpha_{1.2}(x)-180°$." to --$\beta_1(x) = \alpha_{3,1}(x) - \alpha_{1,2}(x) - 180°$.--.

In column 12 at line 54, Change "$\alpha_{3.1}$" to --$\alpha_{3,1}$--.

In column 13 at line 52, Change "$\phi_{2.4}$" to --$\phi_{2,4}$--.

Signed and Sealed this
Second Day of December, 2014

Michelle K. Lee

Michelle K. Lee
*Deputy Director of the United States Patent and Trademark Office*